US005347336A

United States Patent [19]

Yamada et al.

[11] Patent Number: 5,347,336

[45] Date of Patent: Sep. 13, 1994

[54] PHOTOGRAPHIC SILVER HALIDE PHOTOSENSITIVE MATERIAL PROCESSING APPARATUS AND METHOD OF PREVENTING BIO-SLIME GENERATION IN A WASH TANK THEREOF

[75] Inventors: Minoru Yamada, Minami-ashigara; Katsumi Hayashi, Odawara, both of Japan

[73] Assignee: Fuji Photo Film Co., Ltd., Kanagawa, Japan

[21] Appl. No.: 844,865

[22] Filed: Mar. 2, 1992

Related U.S. Application Data

[63] Continuation of Ser. No. 506,635, Apr. 9, 1990, abandoned.

[30] Foreign Application Priority Data

Apr. 11, 1989 [JP] Japan ..... 1-91533

[51] Int. Cl.[5] ..... G03D 3/02

[52] U.S. Cl. ..... 354/324

[58] Field of Search ..... 354/319-324

[56] References Cited

U.S. PATENT DOCUMENTS

| | | | |
|---|---|---|---|
| 2,046,467 | 7/1936 | Krause | 210/764 |
| 3,589,263 | 6/1971 | Casey | 354/324 |
| 3,868,715 | 2/1975 | Slavin | 354/324 |
| 4,101,919 | 7/1978 | Ammann | 354/319 |
| 4,189,803 | 2/1980 | Schausberger et al. | 134/64 P X |
| 4,268,619 | 5/1981 | Dunagan | 204/149 |
| 4,324,481 | 4/1982 | Becherer | 354/324 |
| 4,429,982 | 2/1984 | Martino et al. | 354/318 |
| 4,432,475 | 2/1984 | Lee et al. | 222/518 X |
| 4,650,308 | 3/1987 | Burbury | 354/324 |
| 4,728,441 | 3/1988 | King | 210/760 |
| 4,828,717 | 5/1989 | DeLeeuw et al. | 354/325 |
| 4,829,330 | 5/1989 | Yamada et al. | 354/322 |
| 4,902,432 | 2/1990 | Kuno | 200/764 |
| 4,931,378 | 6/1990 | Hirano et al. | 354/320 X |
| 5,040,013 | 8/1991 | Kurokawa et al. | 354/322 |

FOREIGN PATENT DOCUMENTS

| | | |
|---|---|---|
| 2826107 | 1/1979 | Fed. Rep. of Germany . |
| 57-8542 | 1/1982 | Japan . |
| 57-157244 | 9/1982 | Japan . |
| 62-209532 | 9/1987 | Japan . |
| 62-215508 | 9/1987 | Japan . |
| 2067593 | 7/1981 | United Kingdom . |
| 1602768 | 11/1981 | United Kingdom . |

OTHER PUBLICATIONS

"Water Flow Rates in Immersion-Washing of Motion-Picture Film", Samuel R. Goldwasser, *Journal of the SMPTE*, vol. 64, May 1955, pp. 248-253.

"Water Quality Criteria", Lloyd E. West, *Photographic Science and Engineering*, vol. 9, No. 6, Nov.-Dec. 1965, pp. 398-413.

"Microbiological Growths in Motion-Picture Processing", Margaret W. Beach, *SMPTE Journal*, vol. 85, Mar., 1976, pp. 155-158.

"Photoprocessing Wash Water Biocides", Richard O. Deegan, *Journal of Imaging Technology* 10, 1984, pp. 239-241.

*Primary Examiner*—D. Rutledge

*Attorney, Agent, or Firm*—Sughrue, Mion, Zinn, Macpeak & Seas

[57] ABSTRACT

In a photosensitive material processing apparatus having a wash tank for washing photosensitive material with a relatively large volume of water after development, means for releasing silver cations into wash water is provided for preventing bio-slime generation in the wash tank. Silver cations can be dissolved out from a silver alloy through electrolysis or from a silver release agent. A method for preventing bio-slime from accumulating in the wash tank includes the steps of: releasing silver cations into wash water, and optionally, draining wash water from the wash tank, and forcedly drying the wash tank.

5 Claims, 7 Drawing Sheets

PHOTOGRAPHIC SILVER HALIDE PHOTOSENSITIVE MATERIAL PROCESSING APPARATUS AND METHOD OF PREVENTING BIO-SLIME GENERATION IN A WASH TANK THEREOF

This is a continuation of application Ser. No. 07/506,635, filed Apr. 9, 1990 now abandoned.

This invention relates to an apparatus for processing photographic silver halide photosensitive material, typically an automatic processor and a method for preventing bio-slime generation in a wash tank thereof. Bio-slime is the result of microbial accumulation in processing wash water.

BACKGROUND OF THE INVENTION

Photographic black-and-white silver halide photosensitive materials are generally processed through steps of development, fixation, and water washing. This type of processing, presents problems relating to environmental protection and water conservation.

One approach to minimizing environmental effects is to reduce the necessary amount of wash water which has been used in processing 3 to 20 liters of wash water per square meter of photosensitive film is typical. For example, counter current washing through a plurality of wash tanks is disclosed in S. R. Goldwasser, "Water flow rate in immersion-washing of motion picture film," J. SMPTE, 64, 248–253, May 1955. This technique is commonly used to reduce wash water volumes in automatic processors for photographic color film.

In automatic processors for x-ray photosensitive film, it is now common to conserve water as much as possible by opening an electromagnetic valve to supply wash water only during a processing period. If the multiple-tank counter current washing technique is applied to automatic processors for sheet photosensitive material such as x-ray photosensitive film and printing photosensitive material, a number of rollers and racks corresponding to the number of wash tanks must be utilized, adding to push the initial cost of the automatic processor beyond a commercially acceptable level and increasing the space for the installation thereof.

Therefore, most automatic processors for processing sheet black-and-white photosensitive material depend on the conventional mass water washing mode wherein the processor is equipped with a single wash tank, or primary and auxiliary wash tanks, or at most double wash tanks. In such a system at least 3 liters per square meter of the photosensitive material of wash water is replenished.

Often wash water is kept for some time in a wash tank. Then bio-slime will adhere to the tank wall within 2 or 3 weeks and the water will stagnate or rot giving off foul odors. When the automatic processor is turned off and discontinued for several days, suspended matter will appear in the water in the wash tank. Such suspended matter will eventually adhere to a photosensitive material or cause clogging of associated filters. Therefore, the wash tank must be periodically scrubbed to remove bio-slime and suspended matter. When bio-slime accumulates on a roller conveyor system which includes a number of moving components, scrubbing the rollers and racks to remove the bio-slime is a cumbersome operation.

For bio-slime control, it was a common practice to add chelating agents and biocidal agents to wash water as disclosed in L. E. West, Water Quality Criteria Phot. Sci. and Eng., Vol. 9, No. 6, 398 (1965); M. E. Beach, "Microbiological growth in Motion-Picture Processing," SMPTE Journal, Vol. 85, Mar. 1976; and R. O. Deegan, "Photoprocessing Wash Water Biocides," J. Imaging Tech., Vol. 10, No. 6, Dec. 1984. Also, Japanese Patent Application Unexamined Publication (JP-A) Nos. 8542/1982, 105145/1983, and 157244/1982 disclose the addition of various antifungal agents such as thiazolylbenzimidazoles and isothiazolones. Although the concept of adding a biocidal or fungicidal compound to wash water is helpful, the mass water washing mode, however, makes it difficult to maintain the compound at an effective concentration so as to provide biocidal and fungicidal action. In addition, some chemical agents are costly and some are toxic. No satisfactory method of bio-slime prevention has previously been achieved.

SUMMARY OF THE INVENTION

Therefore, an object of the present invention is to provide an apparatus for processing sheets of photographic silver halide photosensitive material which enables mass water washing after development without allowing bio-slime or suspended matter to grow or form.

Another object of the present invention is to provide a relatively inexpensive automatic processor for processing sheets of photographic silver halide photosensitive material, having a wash tank which is designed for bio-slime prevention.

The invention is related to an apparatus for processing a photographic silver halide photosensitive material, having a wash tank for washing the photosensitive material with water after development. Most often, the apparatus also includes a processing section including a developing tank and a tank having a fixing function in juxtaposition, and a drying section for drying the photosensitive material after processing. The apparatus depends on a mass water washing mode wherein at least 0.2 liters of wash water per square meter of the photosensitive material is replenished to the wash tank. According to a first aspect of the invention, a device for releasing silver cations into wash water is provided for preventing bio-slime generation in the wash tank.

In one preferred embodiment, the silver cation releasing a device includes a pair of electrodes disposed in the wash water, at least one electrode releasing silver cations. Alternatively, the silver cation releasing device includes a source disposed in the wash water for slowly releasing silver cations, more particularly in the form of an amorphous soluble glass containing silver.

The silver cation releasing device may be disposed in the wash tank. In another embodiment where apparatus also has a water stock tank for supplying water to the wash tank, the silver cation releasing device is disposed in either or both of the wash tank and the water stock tank.

The wash tank has an inclined bottom and a drain port at the lowest position of the bottom. Thereby, the wash tank may be emptied of wash water. There may also be provided a device for introducing drying air from the drying section into the empty wash tank, thereby drying the wash tank. Preferably, a device for supplying ozone into wash water is additionally provided.

According to a second aspect of the present invention, there is provided a method for preventing bio-slime from accumulating in the wash tank, comprising the steps of providing silver cation releasing means for dissolving $Ag^+$ ions into the wash water, and draining the wash water from the wash tank through the drain port at the end of processing.

Alternatively, the method may include the steps of providing silver cation releasing means for dissolving $Ag^+$ ions into the wash water, and during a quiescent period, draining the wash water from the wash tank through the drain port, filling the wash tank with fresh water at least once, and draining the water again, thereby preventing bio-slime generation during the quiescent period.

The method may include the steps of providing silver cation releasing means for dissolving $Ag^+$ ions into the wash water, and during a quiescent period, draining the wash water from the wash tank through the drain port, and rotating the transport roller to splash off water therefrom, thereby preventing bio-slime generation during the quiescent period.

The method may also include the steps of providing silver cation releasing means for dissolving $Ag^+$ ions into the wash water, and replacing the water in the wash tank by fresh water whenever the apparatus remains standby over a predetermined time, thereby preventing bio-slime generation during a quiescent period.

The method may also include the steps of providing silver cation releasing means for dissolving $Ag^+$ ions into the wash water, and draining the wash water from the wash tank through the drain port and forcedly drying the interior of the wash tank or the method may include the steps of releasing $Ag^+$ ions into the wash water, and supplying ozone into the wash water.

The above and other objects of the present invention together with the features and advantages thereof will become apparent from the following detailed description when read in conjunction with the accompanying drawings.

DESCRIPTION OF THE PREFERRED EMBODIMENTS

Figure 1:
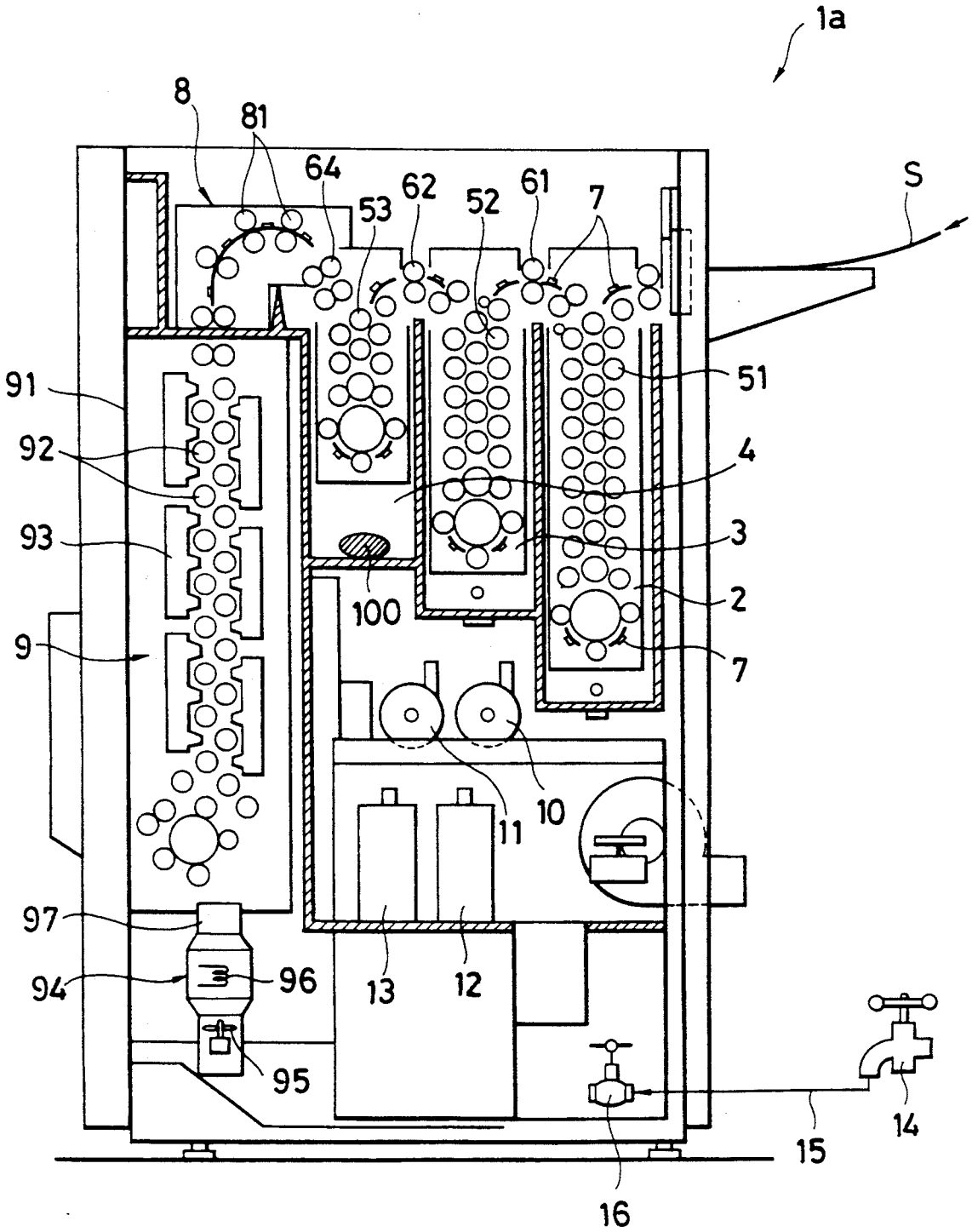
FIGS. 1 and 2 are schematic cross-sectional views of photosensitive material processing apparatus according to first and second embodiments of the present invention.
Figure 2:
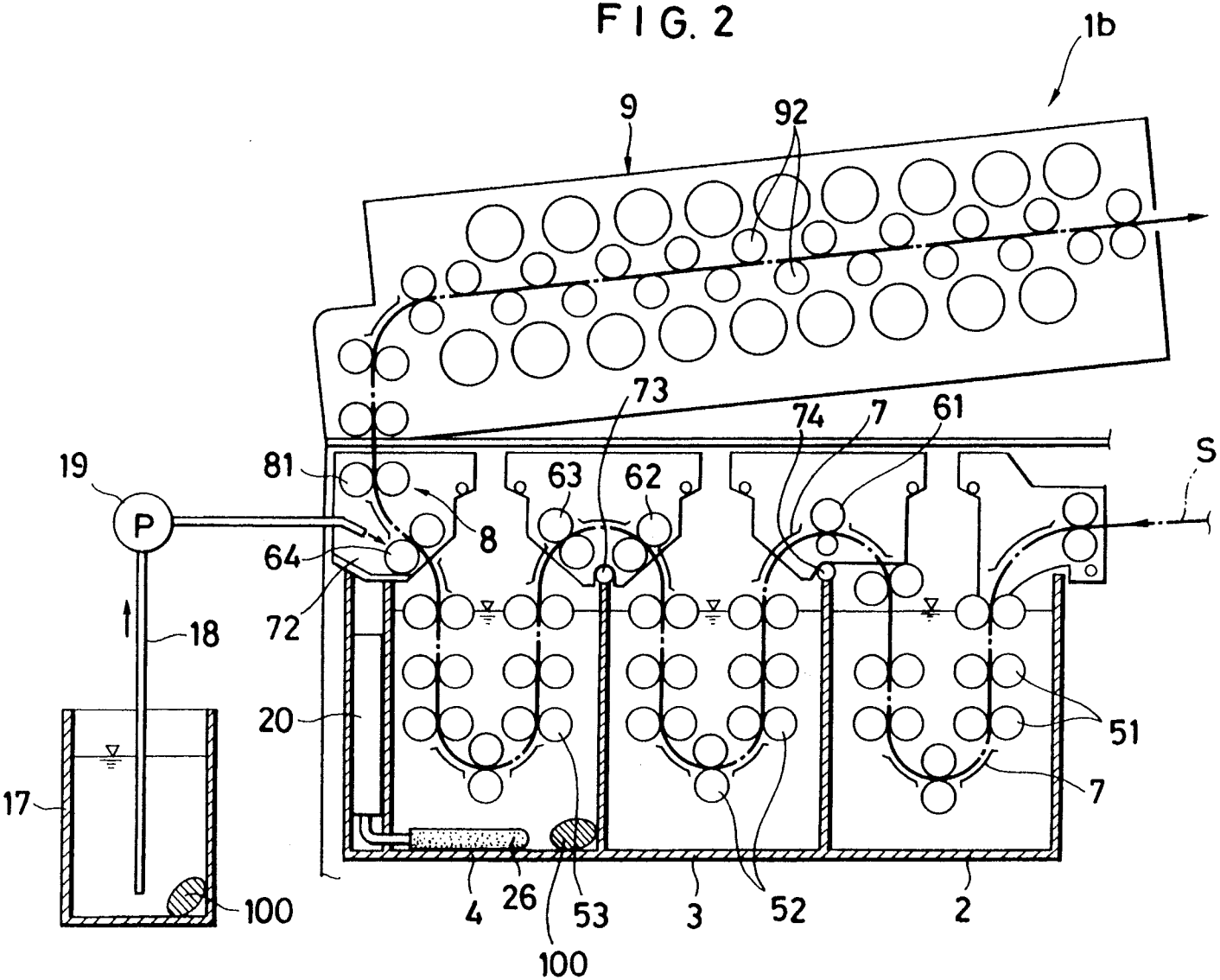

FIGS. 1 and 2 illustrate preferred embodiments of the photosensitive material processing apparatus according to the present invention.

The photosensitive material processing apparatus illustrated herein are of the roller transfer type wherein a sheet or strip of photographic silver halide photosensitive material (to be referred to as photosensitive material, hereinafter) is carried forward by means of rollers, and adopts the mass water washing mode requiring a relatively large volume of wash water to be replenished.

The type and shape of the photosensitive material to be processed with the apparatus of the invention is not critical. However, the invention is most advantageously applied to the processing of black-and-white photosensitive material such as x-ray photosensitive film and printing photosensitive film, and the illustrated apparatus are thus designed for processing such black-and-white photosensitive material.

Referring to FIG. 1, numeral 1*a* designates a photosensitive material processing apparatus which includes several vertically elongated tanks in a housing. A developing tank 2 for containing a developer, a fixing tank 3 for containing a fixing solution, and a wash tank 4 for containing wash water are arranged and juxtaposed in the stated order from the right.

In the developing tank 2 are vertically disposed a series of transport rollers 51 for carrying a photosensitive sheet S along a predetermined path through the developing tank 2. Also in the fixing and washing tanks 3 and 4 are disposed a series of transport rollers 52 and 53 for similar purposes.

Between the processing tanks 2, 3, and 4 and a squeezer section 8 to be described later are disposed pairs of crossover rollers 61, 62, and 64. These crossover rollers 61, 62, and 64 serve to carry the sheet S in a frictional clamping manner and to squeeze off the entraining solution from the sheet surface, thereby preventing substantial dragout of the processing solution from the preceding tank to the following tank.

Preferably the apparatus includes a water supply line 15 connected to a city water line (depicted as a faucet 14) for supplying water to the crossover rollers, thereby removing any deposits of developing and fixing solution ingredients from the rollers to prevent roller contamination. One approach is to spray water to the crossover rollers at the end of daily developing operation (Japanese Patent Application No. 18636/1987). Alternatively, a rinsing tank may be provided such that the crossover rollers may be immersed in water in the rinsing tank at all times.

Guides 7 are disposed between the rollers near the bottom of the respective tanks and across the crossover rollers 61 and 62 for leading the sheet S to the subsequent rollers.

It will be understood that each tank is preferably equipped with a rack assembly having the transport rollers 51 to 53 and the guides 7 assembled in a rack.

The photosensitive sheet S (depicted by a solid line at the right and then by line segments in FIG. 1) enters the housing of the apparatus and successively passes through the developing tank 2, fixing tank 3, and wash tank 4 with the aid of the rollers 51–53, 61, 62, 64 while it is successively dipped in the respective solutions for development, fixation and water washing.

In the processing tanks 2, 3, 4, the respective processing solutions are replenished and discharged as exhausted, and preferably the solutions are forcedly circulated. More particularly, the developing and fixing tanks 2 and 3 are replenished by diluting a concentrated developing or fixing solution with water to form a replenisher having a desired concentration and supplying the replenisher to the tank. Pumps 12 and 13 are used to supply the replenishers to the tanks 2 and 3, respectively. Circulation pumps 10 and 11 are used for forced circulation of the processing solutions in the tanks 2 and 3, respectively (see pump 404 in FIG. 4).

A source of wash water to the wash tank 4 and water for diluting the concentrated solutions may be a water supply line 15 connected to a city water faucet 14. A valve 16 is connected in the line 15 for flow rate regulation.

In the wash tank 4 is disposed silver anion releasing means 100 to be described later, usually on the bottom of the tank.

The squeezer section 8 is disposed next to the wash tank 4 on the left upper side thereof in FIG. 1. The squeezer section 8 includes pairs of squeeze rollers 81 arranged along the sheet transfer path for carrying the sheet S as washed in a frictional clamping manner while squeezing off water therefrom.

A drying section 9 is disposed next to the squeezer section 8, vertically below the squeezer section 8 in FIG. 1. The drying section 9 includes a casing 91, a blower 94 for blowing warm air into the casing 91 for drying purpose, and a series of transport rollers 92 and guides 93 vertically arranged along the sheet transfer path. The blower 94 has a fan 95, a heater 96, and a duct 97 connected to the casing 91 and operates to introduce warm air at a temperature of about 35° to 100° C., preferably about 40° to 80° C. into the casing 91. In the casing 91, the sheet S incoming from the squeezer section 8 is carried forward (downward) by means of the transport rollers 92 while it is dried with warm air.

In FIG. 2, there is illustrated a photosensitive material processing apparatus 1*b* which is different from that of FIG. 1 particularly with respect to the configuration for the supply of wash water. The description of the same elements as in FIG. 1 is omitted herein.

The squeezer section 8 including crossover and squeeze rollers 64 and 81 is disposed next to the wash tank 4. A sump 72 is disposed below the crossover rollers 64.

The apparatus 1*b* includes a water stock tank 17 and a supply conduit 18 extending from the stock tank 17 to the wash tank 4. A pump 19 is disposed intermediate the supply line 18. The supply conduit 18 has an outlet in the squeezer section 8, the outlet being directed toward the crossover rollers 64.

When actuated, the pump 19 pumps wash water from the stock tank 17 to thereby spray the water to the crossover rollers 64 for washing. The wash water used to wash the crossover rollers 64 is then introduced into the wash tank 4. At this point, the sump 72 serves to temporarily store the wash water so that the crossover rollers 64 may be partially immersed in the water for promoted cleaning.

In the apparatus 1*b*, two pairs of crossover rollers 62 and 63 are disposed between the fixing and wash tanks 3 and 4 as seen from FIG. 2. Spargers 73 and 74, which are preferably connected to the water supply conduit 18, are disposed near the crossover rollers 62, 63 and 61, respectively, for spraying water to the rollers for cleaning purposes. The drying section 9 is located vertically above the tanks 2 to 4.

The wash water used herein is preferably adjusted to pH 3 to 10, more preferably pH 4 to 8. A suitable buffer salt may be added to water to maintain an optimum pH level.

Wash water may be replenished by directly supplying water from a city water faucet (14 in FIG. 1) or by supplying water from a water stock tank (17 in FIG. 2). Any other water supply system may occur to those skilled in the art.

Wash water is replenished to the wash tank in an amount of at least 0.2 liters per square meter of photosensitive material. With less than 0.2 liters of water replenished, the silver cation release means 100 can provide less antifungal effect and washing efficiency would be low in the case of the roller transport system.

For optimal antifungal effect and washing efficiency, the amount of water replenished is adjusted to at least 0.5 liters, preferably at least 1 liter, more preferably at least 2 liters, most preferably at least 3 liters, especially at least 4 liters per square meter of photosensitive material. The upper limit is 20 liters, especially 15 liters per square meter of photosensitive material.

As photosensitive material sheets S are processed through the apparatus, wash water is automatically and continuously replenished in proportion to the (surface) area of photosensitive material being processed.

According to the present invention, the apparatus includes the silver cation release means 100 for gradually releasing and dissolving $Ag^+$ ions in wash water.

One example of the silver cation release means 100 is means for electrically releasing silver cations in water on the basis of the Electro-Katadyn process. This is embodied by a pair of electrodes of silver or silver-copper alloy immersed in water. Conduction of electricity across the electrodes causes a trace amount of $Ag^+$ ions to be dissolved away. One commercially available controller is Caribbean Clear Swimming Pool Purifier marketed from Caribbean Clear International of Columbia, S.C., U.S.A.

Another example of the silver cation release means 100 is a water-permeable container or element having received therein a silver cation sustained release source. This is advantageous for simplicity of construction and ease of maintenance. The silver cation sustained release source may be an amorphous soluble glass containing monovalent silver as disclosed in JP-A 39692/1988. The amorphous soluble glass is generally formed from at least one network forming oxide selected from $SiO_2$, $B_2O_3$, and $P_2O_5$, at least one network modifying oxide selected from $Na_2O$, $K_2O$, CaO, MgO, BaO, and ZnO, and at least one intermediate oxide selected from $Al_2O_3$ and $TiO_2$ and contains $Ag_2O$ in an amount of 0.05 to 10% by weight, preferably 0.1 to 5% by weight. Such an amorphous soluble glass is commercially available as Biosure SG from Kinki Pipe Giken K.K. of Japan.

The amorphous soluble glass becomes gel in water, retains a given amount of silver cations in the gel, and gradually release silver cations into water. The glass may be in a mass, granular or powder form. It is received in a water-permeable container which is placed in water. The amorphous soluble glass is used in an amount of 1,000 to 100,000 grams per cubic meter of wash water tank volume.

In the embodiments shown in FIGS. 1 through 6, the silver cation releasing means 100 is embodied by a water-permeable bag having an amorphous soluble glass received therein which is placed in the wash tank 4 and/or the water stock tank 17.

Any other silver cation sustained release sources may be used as long as they allow $Ag^+$ to be dissolved out in trace increments in exchange with $H^+$ in water. For example, Stain Killer commercially available from Keiyo K.K. may be used.

The silver cation release means is preferably controlled such that when immersed in or contacted with about 10 liters of static water at room temperature, it will release $Ag^+$ in a concentration of about 1 to 10,000 ppb, especially about 30 to 1,000 ppb after 24 hours. When water is supplied to the wash tank at a flow rate of about 0.2 to 6 liter/min., especially about 0.5 to 6 liter/min. during development of photosensitive material through a supply conduit having an inner diameter of 3 to 30 mm, the silver cation release means should preferably release silver cations to maintain a concentration of about 1 to 10,000 ppb of $Ag^+$ in the wash water in the wash tank.

The silver cation release means 100 is located on the bottom of the wash tank 4 in the embodiment of FIG. 1, and on the bottom of both the wash tank 4 and the water stock tank 17 in the embodiment of FIG. 2. The silver cation release means 100 may be located in either of the wash tank 4 and the water stock tank 17 in the embodiment of FIG. 2. Alternatively, the silver cation release means 100 may be located in a circulation system for the wash tank or a water supply system for the wash tank. However, in the case of a roller transport system, it is most preferred to locate the silver cation release means 100 in the wash tank 4 for bio-slime prevention and system maintenance.

In the illustrated embodiment, the wash tank 4 is of a roller conveyor system wherein the photosensitive sheet S is transported by rollers and of a single tank system wherein a large volume of water is used for washing. The silver cation release means 100 is particularly effective in bio-slime prevention in such a mass water washing system as compared with the prior art addition of antifungal agents.

In the illustrated embodiment, all the tanks are of a roller conveyor system wherein the photosensitive sheet S is transported by rollers. The photosensitive sheet S after exposure is successively transferred through the developing tank 2, fixing tank 3, and wash tank 4 and then through the drying section, completing the development process.

The wash tank 4 and/or water stock tank 17 having the silver cation release means 100 disposed therein may be provided with a drain line having an electromagnetic valve so that water may be drained when the apparatus is out of use, thereby minimizing bio-slime generation.

As previously described, two pairs of crossover rollers 62 and 63 are provided between the fixing and wash tanks 3 and 4 for transferring the photosensitive sheet S and squeezing the entraining solution. Preferably, a sparger 73 is provided for spraying water over the crossover rollers 62 and 63 to wash away contaminants resulting from the fixing solution.

The carry-in or drag-out of the fixing solution into the wash tank 4 is preferably limited to 5 to 50 ml, more preferably 10 to 30 ml per square meter of photosensitive material. A drag-out of at least 5 ml is inevitable for mechanical configuration because the transition mechanism must be extremely precise for a less drag-out. A drag-out of more than 50 ml will offset the antifungal effect of the silver cation release means 100 because some fixing ingredients will assist microbial growth and hypo will form a complex with $Ag^+$ ions. It is to be noted that the dragout is measured by filling a fixing tank with a fixer containing a known amount of Ag, filling a wash tank with Ag-free water, processing a predetermined area of photosensitive material without replenishment of the fixer and wash water, and thereafter analyzing the wash water for Ag concentration.

In another preferred embodiment of the invention, ozone supply means may be used in combination with the silver cation release means.

Figure 3:
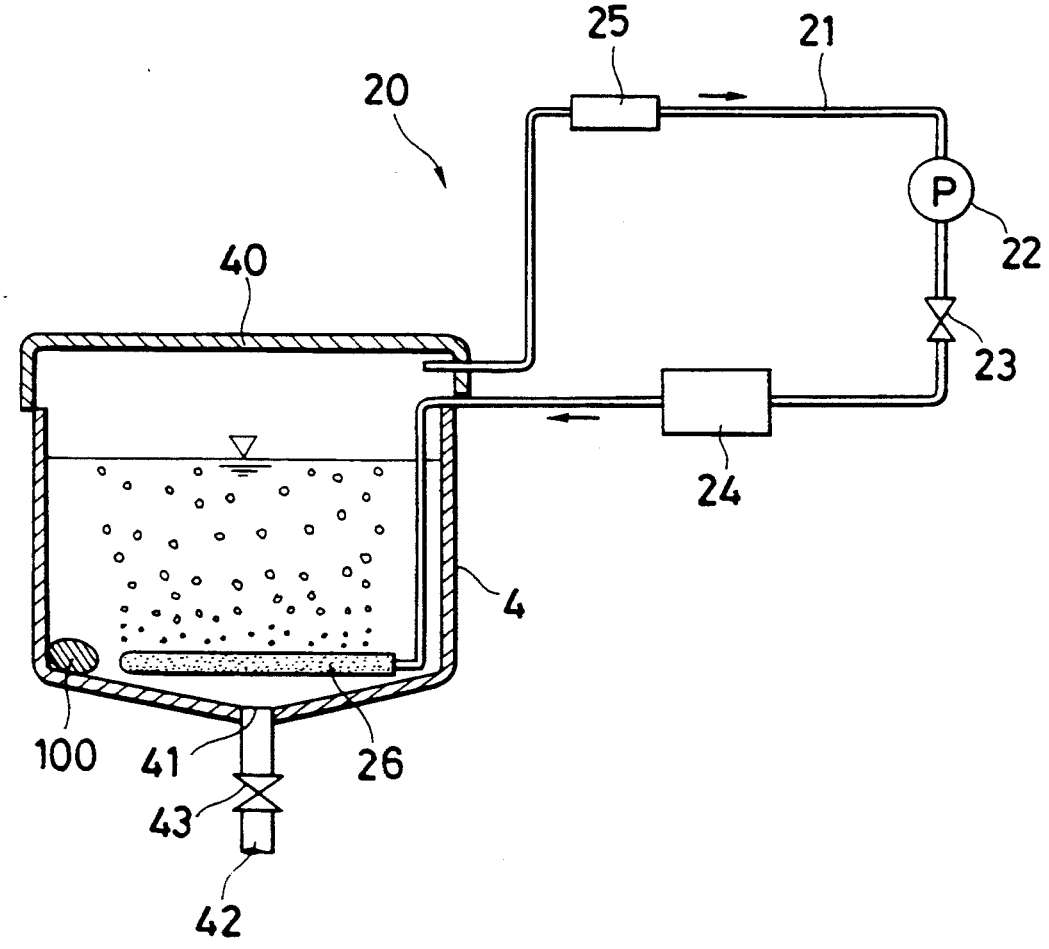
FIGS. 3 and 4 are schematic cross-sectional views of different configurations of ozone supply means used in the apparatus of the invention.
Figure 4:
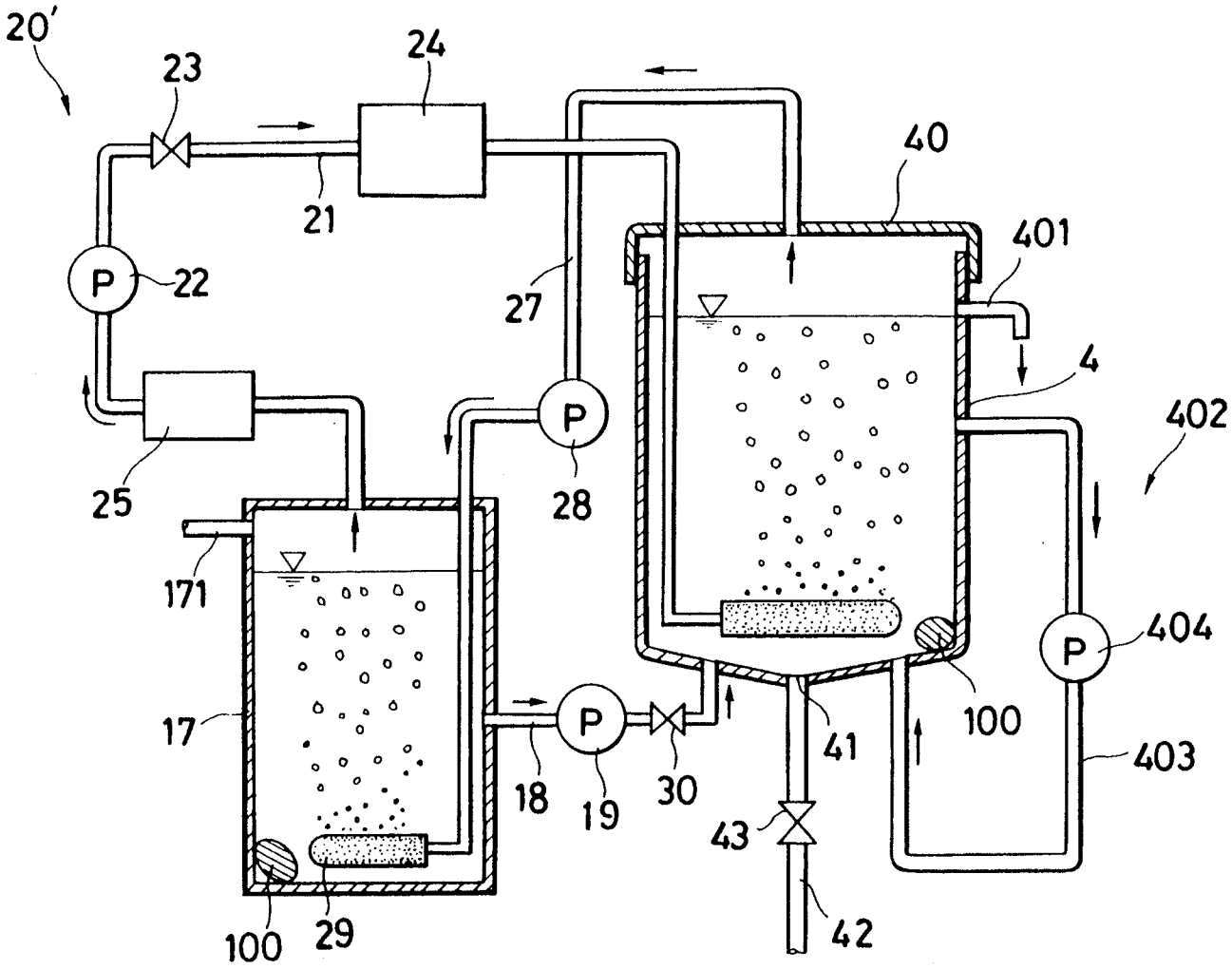

FIGS. 3 and 4 show different configurations of the ozone supply means.

In FIG. 3, the ozone supply means generally depicted at 20 is to supply ozone into wash water in the wash tank 4 by blowing ozone-containing air bubbles therein.

More particularly, the wash tank 4 is provided with a cover 40 which closes the opening of the tank. It is to be noted that transport rollers and other elements in the wash tank 4 are omitted for the brevity of illustration. The wash tank 4 has a bottom which is inclined like a funnel as will be described later. The wash tank 4 has a drain port 41 at the lowest position of its bottom. To the drain port 41 is connected a drain pipe 42 having a valve 43. The valve 43 is closed during operation of the apparatus, that is, during processing of photosensitive material (for example, in the daytime). When the operation of the apparatus, that is, the processing of photosensitive material is interrupted for a certain period of time (for example, in the nighttime or on a holiday), the electromagnetic valve 43 is opened to drain substantially the entire volume of wash water from the wash tank 4 through the drain port 41 and pipe 42. The wash tank 4 is then kept dry during the quiescent period. Then bio-slime prevention is enhanced.

The ozone supply means 20 includes an air supply conduit 21 having an inlet end extending through the cover 40 for communication with the upper space in the wash tank 4 and an outlet end disposed near the bottom of the wash tank 4. The ozone supply means 20 further includes an air pump 22 intermediate the air supply conduit 21, a valve 23 and an ozone generator 24 disposed on the discharge side of the pump 22, and a filter 25 disposed on the suction side of the pump 22.

The outlet end of the air supply conduit 21 which is disposed near the tank bottom and hence, in wash water is provided with a bubbler 26 of porous material for generating bubbles. The bubbler may be a glass pole filter, sintered foam polyethylene filter, foamed polyurethane filter, porous biscuit filter or the like. A plurality of bubblers 26 may be disposed in the wash tank 4.

The ozone generator 24 may utilize silent discharge, electrolysis, photochemical reaction, radiation irradiation, high-frequency electric field or the like. An ozone generator utilizing a plasma resonance discharge is preferred because it can selectively excite oxygen atoms thereby efficiently generating ozone with minimal emission of NOx. Commercial examples of the ozone generator are Pasteur Ozonizer LB series by Ozone K.K., Ozonizer by Lacy K.K., and an ozone generator by Nikko Hetal Industry K.K.

The amount of ozone supplied into wash water is preferably in the range of 5 to 500 mg/hour, more preferably 10 to 300 mg/hour, most preferably 20 to 200 mg/hour. Less than 5 mg/hour of ozone achieves less biocidal effect. More than 500 mg/hour of ozone is not recommended for toxicity in a working environment and an increased investment. Usually, the amount of ozone supplied into wash water may be controlled through an adjustment of the voltage applied to the ozone generator. The amount of ozone supplied into wash water is determined from the total gas discharge of the ozone generator and the ozone concentration therein. The ozone concentration may be measured by an ozone concentration meter Dasibi Ozone Monitor, model DY-1500 manufactured by Osaka Dylec K.K., for example.

The amount of air supplied by the air pump 22 preferably ranges from about 0.5 to about 20 liter/min. although it varies with the volume of the wash tank of the apparatus.

It is preferred for the ozone supply means 20 that a provision is made so as to prevent the escape of ozone to the surrounding environment. To this end, the upper opening of the wash tank 4 is closed by the cover 40 and the inlet end of the air supply conduit 21 is extended into the space above the wash water whereby the air bubbled into the wash water is recovered and circulated for repeated bubbling into the wash water.

The filter 25 in the air supply conduit 21 collects the ozone which has not been dissolved in the wash water and cleans the air in which ozone is to be generated, thereby increasing the operating efficiency and life of the ozone generator. An active carbon filter commercially available as Secard MR-4 from Shinagawa Shirorenga K.K. is useful as the filter 25.

The ozone supply means 20 is operated by opening the valve 23 and actuating the ozone generator 24 and the air pump 22. Then the air pump 22 delivers air through the air supply conduit 21 to the ozone generator 24 where part of oxygen in the air is converted into ozone, providing ozone-containing air. The ozone-containing air is further pumped to the bubbler 26 and injected into the wash water as fine bubbles through a multiplicity of pores in the bubbler 26.

Air bubbles rise up to the surface of wash water and join the air in the space between the water surface and the cover 40. The air (containing ozone) in the space is sucked into the air supply conduit 21 at the inlet port and fed back to the air pump 22 after excess ozone is removed by the filter 25.

Ozone in air bubbles is partially dissolved in the wash water in the wash tank 4 where ozone is effective in killing bacteria or suppressing bacteria growth, preventing bio-slime generation.

Referring to FIG. 4, there is illustrated another arrangement of ozone supply means generally depicted at 20' as supplying ozone into wash waters in the wash tank 4 and water stock tank 17 by blowing ozone-containing air bubbles therein.

More particularly, the wash tank 4 is provided with a cover 40 which closes the opening of the tank. It is to be noted that transport rollers and other elements in the wash tank 4 are omitted for the brevity of illustration. The wash tank 4 has a funnel-shaped bottom and a drain port 41 to which a drain pipe 42 having a valve 43 is connected as in the previous embodiment for the same purposes.

The water stock tank 17 is a closed tank or an open tank with a cover closing the top opening thereof. A water supply conduit 171 is connected to an upper portion of the stock tank 17 in communication with the tank interior for supplying wash water to the stock tank 17. A water delivery conduit 18 connects the water stock tank 17 to the wash tank 4 and has a pump 19 and a valve 30. The pump 19, when actuated, pumps a predetermined replenishing amount of water from the stock tank 17 to the wash tank 4 through the conduit 18. The water delivery system including the water delivery conduit 18, pump 19 and the like may be arranged such that water is sprayed over the crossover or squeeze rollers before it is delivered to the wash tank 4 as previously described in conjunction with FIG. 2.

The wash tank 4 is provided with an overflow port 401 at an upper wall portion thereof for maintaining the surface of wash water at the predetermined level. The wash tank 4 is further provided with a system 402 for circulating the wash water. The circulation system 402 includes a line 403 having inlet and outlet ports in the side wall and the bottom of the tank 4 in fluid communication with the tank interior and a pump 404 disposed intermediate the line 403. The circulation system 402 causes the wash water to circulate in the wash tank 4, thereby increasing the washing efficiency of photosensitive material and partially contributing to suppression of bio-slime generation.

The ozone supply means 20' shown in FIG. 4 includes an air supply conduit 21 having an inlet port connected to the water stock tank 17 for communication with the upper space in the tank 17 and an outlet port disposed near the bottom of the wash tank 4. The ozone supply means 20' further includes an air pump 22 intermediate the air supply conduit 21, a valve 23 and an ozone generator 24 disposed on the discharge side of the pump 22, and a filter 25 disposed on the suction side of the pump 22. The outlet end of the air supply conduit 21 which is disposed near the tank bottom and hence, in wash water is provided with a bubbler 26 of porous material for generating bubbles.

The ozone supply means 20' further includes a second air supply conduit 27 having an inlet port connected to the wash tank 4 for communication with the upper space in the tank 4 and an outlet port disposed near the bottom of the water stock tank 17. The ozone supply means 20' further includes a second air pump 28 intermediate the second conduit 27. The outlet end of the second conduit 27 which is disposed near the stock tank bottom and hence, in water is provided with a second bubbler 29 of porous material for generating bubbles.

These elements of the ozone supply means 20' are substantially the same as those of the ozone supply means 20 described in FIG. 3. The operating parameters including the ozone supply amount and the air discharge of air pump 22 are also the same as previously described. The air pumps 22 and 28 may have a substantially equal air discharge.

The ozone supply means 20 is operated by opening the valve 23 and actuating the ozone generator 24 and the air pump 22. Then the air pump 22 delivers air through the air supply conduit 21 to the ozone generator 24 where part of oxygen in the air is converted into ozone, providing ozone-containing air. The ozone-containing air is further pumped to the bubbler 26 and injected into the wash water in the wash tank 4 as fine bubbles through a multiplicity of pores in the bubbler 26.

Air bubbles rise up to the surface of wash water and join the air in the space between the water surface and the cover 40. The air (containing ozone) in the space is sucked into the second air supply conduit 27 at the inlet port by means of the second air pump 28, further pumped to the second bubbler 29, and injected into the water in the stock tank 17 as fine bubbles through a multiplicity of pores in the bubbler 29.

Air bubbles rise up to the surface of water and join the air in the upper space of the stock tank 17. The air (containing ozone) in the space is sucked into the first air supply conduit 21 at its inlet port and fed back to the pump 22 after excess ozone is removed by the filter 25.

Ozone in air bubbles is partially dissolved in the wash waters in the wash tank 4 and stock tank 17 where ozone contact provides bactericidal effect, killing bacteria or suppressing bacteria growth, thereby preventing bio-slime generation.

FIG. 2 shows that the ozone supply means 20 or 20' as shown in FIG. 3 or 4 is used in combination with the silver cation release means 100 in the wash tank 4 of the processing apparatus. It is not critical where the ozone supply means is located insofar as it can supply ozone into wash water and does not impede the silver cation release means 100.

The ozone supply means used in the practice of the invention is not limited to the illustrated configuration. For example, the wash tank may be an open tank without a cover such that ozone-containing air blown into the wash water is not recovered or recirculated.

Where ozone is supplied at two or more locations, for example, in two wash tanks, in a wash tank and a water stock tank, or at two or more different locations in a single wash tank, separate ozone supply systems may be independently provided or branches from a single ozone supply system may be used to simultaneously or selectively supply ozone-containing air to different locations. It is possible to independently change the amount of ozone supplied to the locations.

The ozone supply means 20 and 20' of FIGS. 3 and 4 are adapted so as to supply ozone only when the wash tank 4 is filled with wash water. For the processing apparatus 1*b* of FIG. 2 having the water stock tank 17, it is possible to design the ozone supply means so as to supply ozone into water in the stock tank 17 even when the wash tank 4 is empty. In this case, separate ozone supply means may be provided for the wash and stock tanks and independently operated. Alternatively, an air supply conduit of a single ozone supply means may be branched into two, one for the wash tank 4 and the other for the stock tank 17, each branch being provided with a valve so that ozone may be selectively supplied to only the stock tank 17 or both the wash tank 4 and the stock tank 17 under control of the valve.

It is to be noted that the silver cation release means is located anywhere in the wash tank 4, water stock tank 17 or circulation system 402 in all the embodiments.

Some typical schedules for the ozone supply means 20 or 20' to supply ozone into water are shown below.

(1) Ozone is supplied during processing of photosensitive sheet S.
(2) Ozone is supplied for a certain time at the end of processing of photosensitive sheet S.
(3) Ozone is supplied for a certain time once or plural times in the downtime of the apparatus, that is, in the nighttime when no photosensitive sheet S is processed.
(4) Ozone is supplied for a certain time at equal intervals both during processing and standby periods.
(5) Ozone is supplied for a certain time before the wash tank is drained of wash water in the nighttime or on a holiday.
(6) Ozone is supplied for a certain time in a standby period at the end of processing of photosensitive sheet S.
(7) A combination of any of schedules (1) to (6).

Schedules (2), (3), (4), and (6) are more advantageous in preventing bio-slime generation. Schedule (4) is most advantageous because it ensures that bio-slime generation is prevented under any processing and non-processing conditions.

Schedule (1) of supplying ozone during processing of photosensitive sheet S has a benefit that agitation of wash water with ozone-containing air bubbles not only enhances washing of the photosensitive sheet S, but also causes decoloring of a sensitizing dye remaining in the photosensitive sheet S or dissolved into the wash water.

Schedule (5) contributes to a reduction of the polluting factor (as expressed by BOD and COD) of wash water drainage.

Schedule (6) is preferred in avoiding any influence of ozone to the person.

The ozone supply schedule may be controlled by a control system using a well-known program timer or a programmed sequence directly coupled to the automatic processor.

It is also possible to vary the amount of ozone supplied when ozone is supplied according to any of the above schedules. For example, the ozone concentration may be varied between the daytime and the nighttime by changing the voltage applied to the ozone generator.

Figure 5:
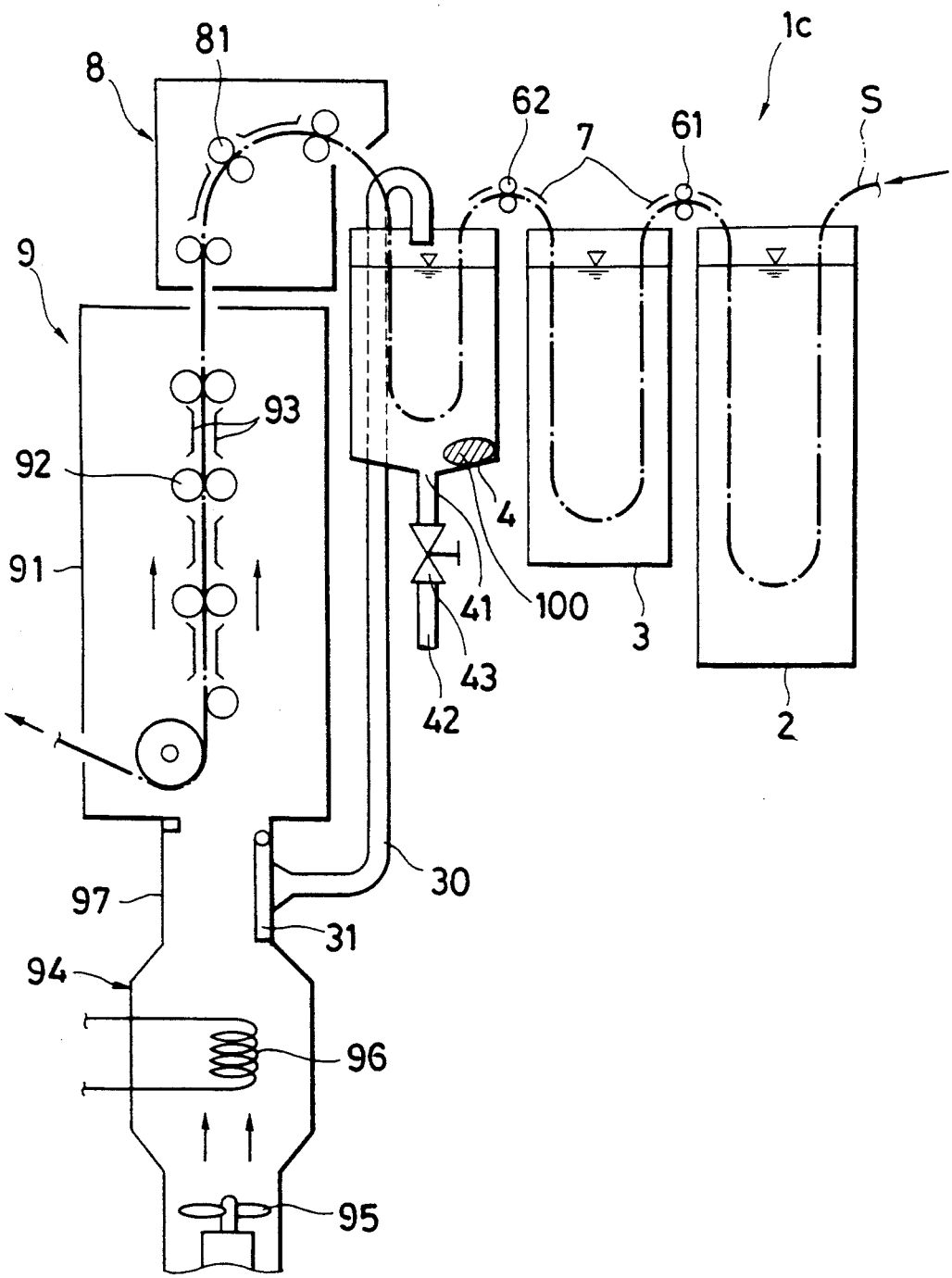
FIGS. 5 and 6 are schematic cross-sectional views of photosensitive material processing apparatus according to a further embodiment of the invention in normal drying and wash tank drying states, respectively.
Figure 6:
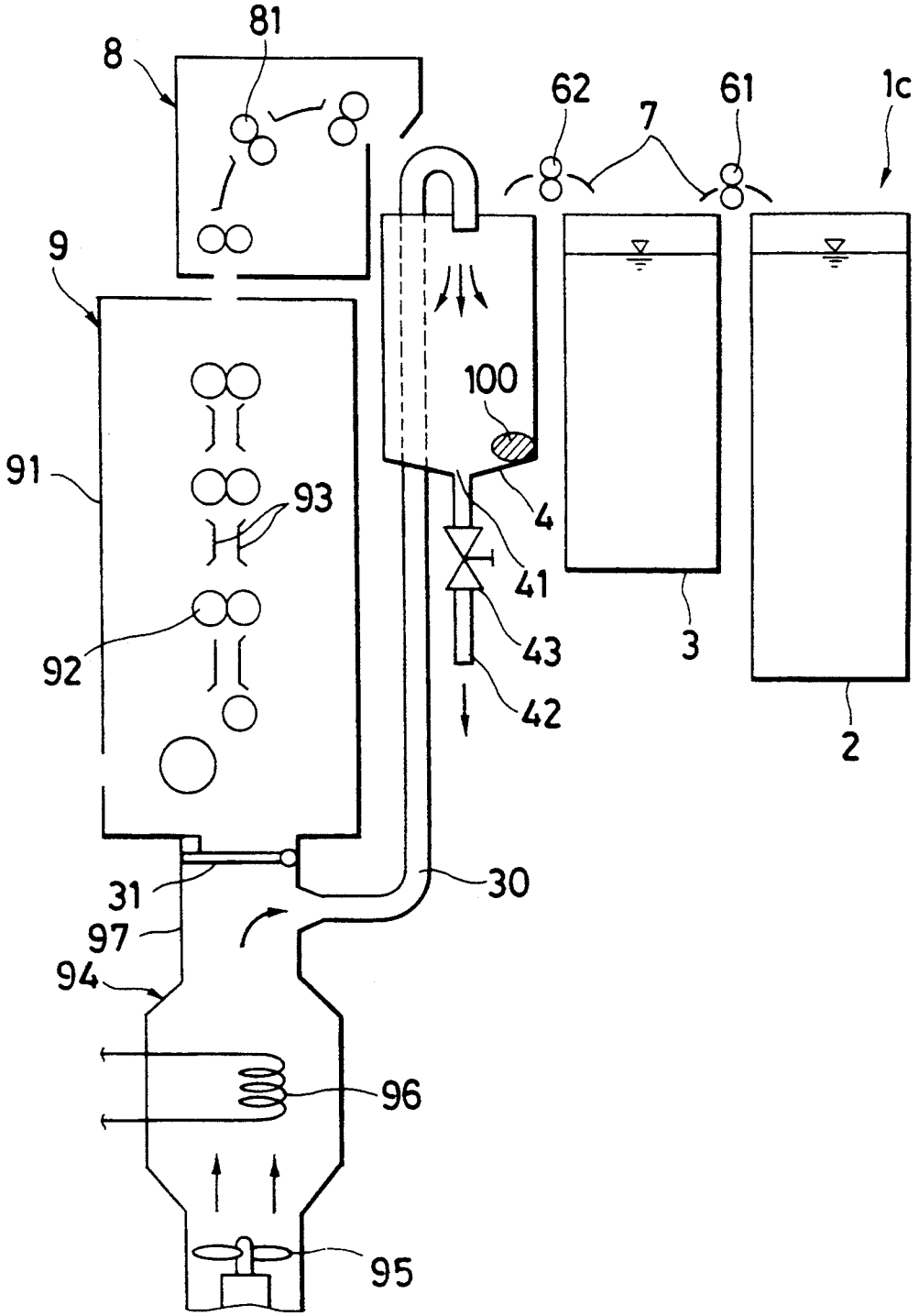

FIGS. 5 and 6 are schematic illustrations of photosensitive material processing apparatus according to a further embodiment of the present invention.

Only the characteristic features of the photosensitive material processing apparatus 1*c* are described and the description of similar elements to those of the previous embodiments is omitted.

The photosensitive material processing apparatus 1*c* includes means for drying the wash tank 4. An air conduit 30 has one end connected to the duct 97 of the drying section 9 and the other end of the conduit 30 is extended into the wash tank 4. A baffle plate 31 is rotatably mounted in the duct 97 adjacent its connection to the conduit 30. The baffle 31 can assume a vertical position as shown in FIG. 5 where the baffle 31 closes the port to the air conduit 30 and a horizontal position as shown in FIG. 6 where the baffle 31 closes the transition of the duct 97 to the drying section casing 91.

During processing of photosensitive sheet S or in the daytime, the port to the air conduit 30 is closed by the baffle 31 as shown in FIG. 5.

When the operation of the apparatus or the processing of photosensitive material is interrupted for a long time (e.g., in the nighttime or on a holiday), the valve 43 is opened to drain the wash water from the wash tank 4 through the drain pipe 42 connected to the bottom of the wash tank 4 at the drain port 41. Then the blowing fan 95 and heater 96 are actuated and the baffle 31 is rotated to the horizontal position to close the duct 97 and open the port to the air conduit 30. Substantially the entire amount of warm air enters the conduit 30 through the open port and is blown into the then empty wash tank 4 to forcedly dry the interior of the wash tank 4. This forced drying removes almost completely water drops on the side wall, bottom, transport rollers (not shown), especially the contact zone between paired rollers, guides, bubbler and other elements of the wash tank 4, thereby preventing bio-slime formation on these elements. It is to be understood that "forced drying" is used to exclude natural drying by allowing the elements to stand.

Apart from the illustrated configuration, the duct 97 may be provided with a movable member capable of diverting the air flow therethrough so that a portion of warm air is introduced into the air conduit 30.

The amount of warm air blown for forced drying of the wash tank 4 is preferably less than the amount of air used to dry the photosensitive material, for example, about 5 to 80% of the latter. In the illustrated embodiment, such a reduced amount of air can be blown by reducing the power to the fan 95. The drying air is generally blown into the wash tank 4 at a flow rate of about 50 to 5,000 liter/min., especially about 200 to 3,000 liter/min. although the flow rate varies with the size of the wash tank 4 and other factors.

During drying of the wash tank 4, it is preferred to idle the transport rollers and gears while blowing warm air. This ensures that the elements are quickly dried.

The drying gas used to dry the wash tank 4 is not limited to air although air is most preferred. Its temperature may be room temperature although the drying gas preferably has a temperature of about 35° to 100° C., more preferably about 45° to about 65° C. for efficient drying. If the drying air is at a relatively high temperature of about 70° C. or higher, such hot air presents an additional biocidal effect, minimizing bio-slime formation.

Sufficient drying is achieved in a drying time of about 1 to 15 minutes, especially about 2 to 10 minutes provided that the temperature and amount of drying air are in the above-defined ranges.

Although drying gas is supplied from the drying section 9 to the wash tank 4 in the illustrated embodiment, the invention is not limited thereto. A drying air source separate from the drying section 9 may be used if desired.

Figure 7:
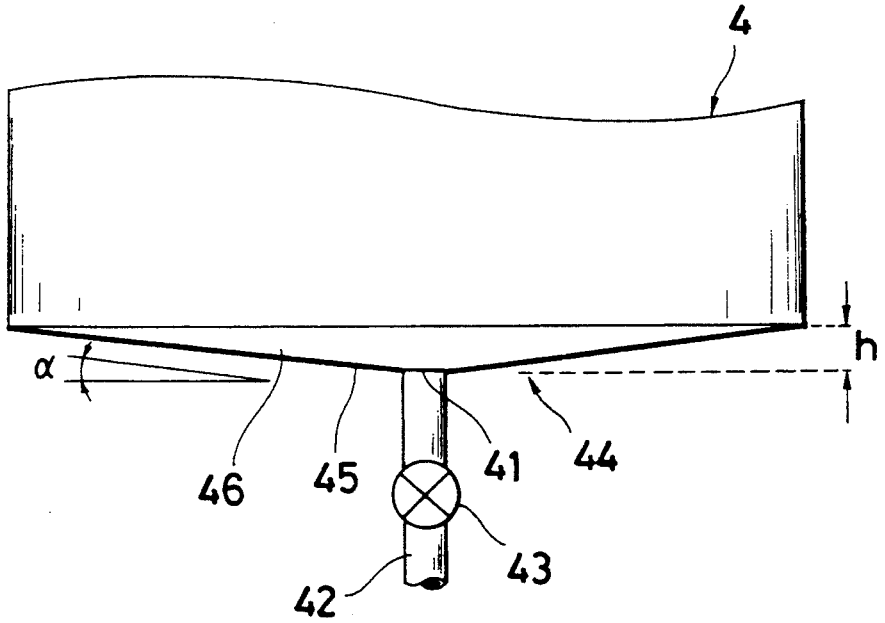
FIGS. 7 and 8 are elevational views of different examples of the wash tank used in the apparatus of the invention.
Figure 8:
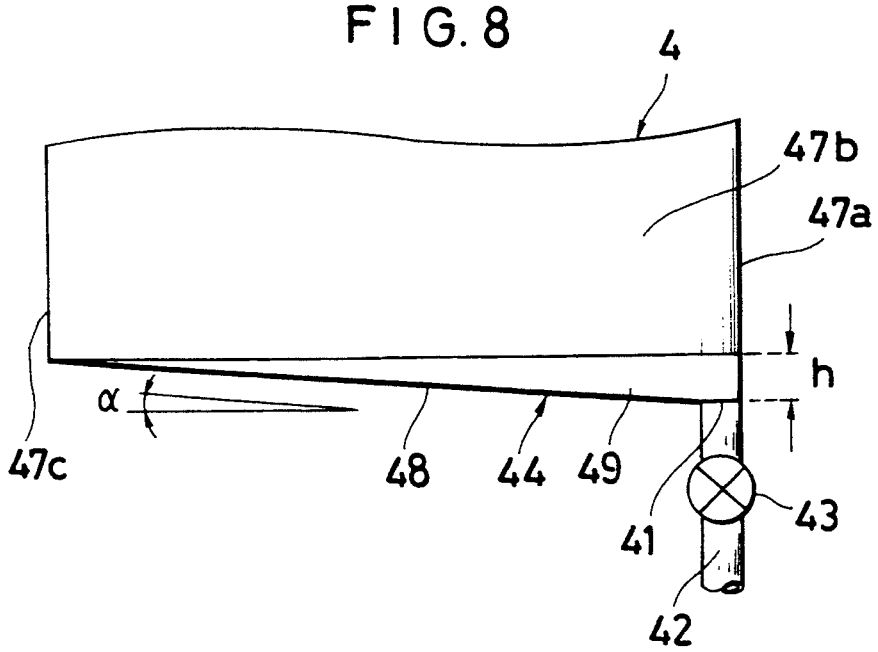

FIGS. 7 and 8 are elevational views of a bottom portion of the wash tank 4.

The bottom of the wash tank 4 is inclined. In FIG. 7, the wash tank 4 of a rectangular shape in horizontal cross section has a centrally inclined bottom 44 depicted as slant surfaces 45 and 46 and a drain port 41 at the lowest center. The bottom 44 is of a reversed pyramid shape consisting of two pairs of slant surfaces 45 and 46 and the drain port 41 is at the lowest center position. The bottom surfaces 45 and 46 have different inclination angles.

In FIG. 8, a drain port 41 is disposed adjacent one side wall 47*a* of the wash tank 4 and bottom surfaces 48 and 49 extend downward from the remaining side walls (only two side walls 47*b* and 47*c* are shown) to the drain port 41. The bottom surfaces have different inclination angles depending on their orientation.

The bottom surface extending along the longest side (bottom surfaces 45 and 48 in FIGS. 7 and 8, respectively) generally has an inclination angle $\alpha$ of at least 1 degree, preferably 2 to 15 degrees, more preferably 2 to 10 degrees. The height h from the drain port 41 to the lowest position of the side wall is generally in the range of 10 to 150 mm, preferably 10 to 100 mm, more preferably 15 to 80 mm although the exact height varies with the size of the wash tank 4.

The transitions between the side walls and the bottom surfaces 45, 46 or 48, 49 of the wash tank 4 and the transitions between the bottom surfaces and the drain port 41 are preferably rounded to a predetermined curvature.

The slant bottom surfaces are planar in the illustrated embodiments, but may be curved. Unlike the illustrated embodiment, the bottom may consist of a continuous curved surface, preferably having an inclination angle of at least 5°.

The wash tank 4 having a bottom inclined toward a drain port can be completely emptied of the wash water after drainage. This ensures that the wash tank 4 is quickly dried over the entire walls. It should be understood that a wash tank having a bottom of flat structure is encompassed within the scope of the invention.

A practice recommended for the photosensitive material processing apparatus 1*c* is to open the valve 43 to drain the wash water from the wash tank 4 through the drain pipe 42 at the end of operation of the processing apparatus, for example, at the end of its daily operation. Therefore, a sequence of water drainage at the end of daily operation should preferably be incorporated in a program for operating the processing apparatus 1*c*.

A sequence of draining the used wash water at the end of daily operation, then filling the wash tank 4 with fresh water, and draining the water again is more preferred because more contaminants are removed from the wash tank and bio-slime generation is minimized.

An equivalent effect is achieved by a sequence of draining the used wash water at the end of daily operation, then spraying fresh water to the wash tank 4, and draining the spray water through the drain port.

By causing the transport rollers to idle to splash off water therefrom after the scheduled water drainage, the transport rollers can be more quickly and fully dried.

Bio-slime generation is minimized by employing a sequence of automatically exchanging wash water if a standby state continues in excess of a predetermined time (for example, one hour) during the daily operation period. Ozone may be supplied into the wash water during the standby state.

In the practice of the invention, the foregoing operations may be carried out in any desired combination. It is to be noted that these operations are effective with a washing mode requiring wash water exchange rather than a basin washing mode without water exchange.

The apparatus of the invention is of the roller transport type and adapted for the processing of sheet black-and-white photosensitive material.

In the practice of the present invention, the developing tank is filled with a developer. The developer contains a developing agent which is preferably a mixture of a dihydroxybenzene and a 1-phenyl-3-pyrazolidone or a mixture of a dihydroxybenzene and a p-aminophenol. Examples of the dihydroxybenzene developing agent include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, with the hydroquinone being most preferred. Examples of the p-aminophenol developing agent include N-methyl-p-aminophenol, p-aminophenol, N-($\beta$-hydroxyethyl)-p-aminophenol, N-(4-hydroxyphenyl)glycine, 2-methyl-p-aminophenol, and p-benzylaminophenol, with the N-methyl-p-aminophenol being most preferred. Examples of the 3-pyrazolidone developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone. The developing agent is generally contained in an amount of 0.001 to 1.2 mol/liter.

The developer further contains a sulfite preservative, examples of which include sodium sulfite, potassium sulfite, lithium sulfite, ammonium sulfite, sodium bisulfite, and potassium metabisulfite. The sulfite is generally contained in an amount of at least 0.2 mol/liter, preferably from 0.4 to 2.5 mol/liter.

The developer is preferably adjusted to pH 8.5 to 13, more preferably pH 9 to 12. The alkaline agents used for pH adjustment include various pH adjusting agents such as sodium hydroxide, potassium hydroxide, sodium carbonate, potassium carbonate, sodium tertiary phosphate, and potassium tertiary phosphate. Buffer agents may also be used, for example, borates as disclosed in JP-A 186259/1987, saccharose, acetoxime, and 2-sulfosalicylic acid as disclosed in JP-A 93433/1985, phosphates, and carbonates.

The developer may further contain a hardening agent. The preferred hardening agents are dialdehyde hardening agents and bisulfite adducts thereof, for example, glutaraldehyde and bisulfite adduct thereof.

The developer may further contain various additives, for example, development restrainers such as sodium bromide, potassium bromide, and potassium iodide; organic solvents such as ethylene glycol, diethylene glycol, triethylene glycol, dimethylformamide, methyl cellosolve, hexylene glycol, ethanol, and methanol; and antifoggants including mercapto compounds such as 1-phenyl-5-mercaptotetrazole and sodium 2-mercaptobenzimidazole-5-sulfonate, indazoles such as 5-nitroindazole, benztriazoles such as 5-methylbenztriazole. Other useful additives include development promoters as disclosed in Research Disclosure, Vol. 176, No. 17643, page XXI, December 1978, color toning agents, surface-active agents, defoaming agents, and water softeners as well as amino compounds as disclosed in JP-A 106244/1971.

The developer may further contain a silver stain remover, for example, a compound as disclosed in JP-A 24347/1971.

The developer may further contain amino compounds such as alkanol amines as disclosed in JP-A 106244/1981 and EP-A 0136582. Other ingredients which may be present in the developer are disclosed in L. F. A. Mason, "Photographic Processing Chemistry," Focal Press, 1966, pages 226–229, U.S. Pat. Nos. 2,193,015 and 2,592,364, and JP-A 64933/1973.

The fixing tank is filled with a fixer which is an aqueous solution containing a thiosulfate fixing agent. The fixer is adjusted to pH 3.8 or higher, preferably pH 4.0 to 7.0, more preferably pH 4.2 to 5.5.

Examples of the fixing agent include sodium thiosulfate and ammonium thiosulfate, with the ammonium thiosulfate being most preferred for fixing rate. The amount of the fixing agent varies over a certain range, preferably from about 0.1 to about 3 mol/liter.

The fixer may contain a hardening agent in the form of a water-soluble aluminum salt such as aluminum chloride, aluminum sulfate, and potassium alum.

The fixer may contain tartaric acid, citric acid, gluconic acid and derivatives thereof alone or in admixture of two or more. These compounds are present in amounts of at least 0.005 mol/liter of the fixer, preferably from about 0.01 to 0.03 mol/liter of the fixer.

The fixer may contain a preservative (e.g., sulfites and bisulfites), a pH buffer (e.g., acetic acid and boric acid), a pH adjusting agent (e.g., sulfuric acid), a chelating agent having water softening ability, and a compound as disclosed in JP-A 78551/1987, if desired.

The wash tank is filled with wash water which is preferably contacted with active carbon or passed through an active carbon filter to remove free chlorine and organic matter before it is supplied to the tank or the water stock tank.

For water washing, antifungal means is preferably applied to wash water or stabilizer in addition to the silver cation release means according to the present invention.

Suitable antifungal means include UV exposure as disclosed in JP-A 263939/1985, magnetic field application as disclosed in JP-A 263940/1985, passage through an ion-exchange resin for purification as disclosed in JP-A 131632/1986, and the use of antifungal agents as disclosed in JP-A 115154/1987, 153952/1987, 209532/1987, and 220951/1987.

In addition, microbiocides, fungicides, and surface-active agents as disclosed in L. F. West, "Water Quality Criteria," Photo. Sci. & Eng., Vol. 9, No. 6 (1965), M. W. Beach, "Microbiological Growth in Motion-Picture Processing," SMPTE Journal, Vol. 85, Mar. 1976, R. O. Deegan, "Photoprocessing Wash Water Biocides," J. Imaging Tech., Vol. 10, No. 6, Dec. 1984, JP-A 8542/1982, 58143/1982, 97530/1982, 132146/1982, 157244/1982, 18631/1983, and 105145/1983, may be used in a suitable combination as necessary.

The washing or stabilizing bath may additionally contain a microbiocide selected from the isothiazolines disclosed in R. T. Kreiman, J. Imaging Tech., 10, 6, page 242 (1984), the isothiazolines disclosed in Research Disclosure, Vol. 205, No. 20526, May 1981, the isothiazolines disclosed in Research Disclosure, Vol. 228, No. 22845, April 1983, and the compounds disclosed in JP-A 209532/1987.

Besides, the bath may contain any of the compounds disclosed in Hiroshi Horiguchi, "Chemistry of Biocides and Fungicides," Sankyo Publishing K.K., 1982 and Japan Biocide and Fungicide Associate, "Handbook of Biocidal and Fungicidal Technology," Hakuhodo K.K., 1986.

In the practice of the present invention, a squeeze roller washing tank as disclosed in JP-A 18350/1988 may be provided, and a washing sequence as disclosed in JP-A 143548/1988 may be employed.

According to the invention, water is replenished to a washing or stabilizing bath while antifungal or anti-slime means is applied thereto. As water is replenished, the used wash water exits the wash tank as an overflow. Part or all of the overflow may be utilized in a processing solution having a fixing function used in the preceding stage as disclosed in JP-A 235133/1985.

The developing time is defined as a duration from a time when the leading edge of a photosensitive sheet to be processed is immersed in a developer in a developing tank of the processor to a time when the sheet leading edge is immersed in a fixer in a next fixing tank. The fixing time is defined as a duration from a time when the of photosensitive sheet leading edge is immersed in the fixer to a time when the sheet leading edge is immersed in a water or stabilizer in a next washing or stabilizing tank. The washing time is defined as a duration when the photosensitive sheet is kept immersed in the wash water. The drying time is defined as a duration when the photosensitive sheet passes through the drying section into which warm air at a temperature of 35° to 100° C., preferably 40° to 80° C. is blown.

The developing time is in the range of from 5 seconds to 3 minutes, preferably from 8 seconds to 2 minutes. The developing temperature is in the range of from 18° to 50° C., preferably 20° to 40° C.

Fixation is generally carried out at about 18° to 50° C. for 5 seconds to 3 minutes, preferably at about 20° to 40° C. for 6 seconds to 2 minutes. Sufficient fixation to dissolve out the sensitizing dye to such an extent as to give no residual color is achieved within this range.

Washing is generally carried out at about 0° to 50° C. for 6 seconds to 3 minutes, preferably at about 10° to 40° C. for 6 seconds to 2 minutes.

In the practice of the invention, the photosensitive material is developed, fixed, and washed or stabilized as above and then dried usually after squeezing off residual wash water through squeeze rollers. Drying is generally carried out at about 40° to 100° C. The drying time may vary with the drying conditions, but is generally from about 5 seconds to about 3 minutes, preferably from about 5 seconds to about 2 minutes at 40° to 80° C.

If it is desired to carry out a development process with the present processing apparatus within 100 seconds on a dry-to-dry basis, a provision is preferably made for preventing a development variation inherent to such rapid processing. This can be achieved in various ways, for example, a roller of rubber material is used as the roller at the exit of the developing tank as disclosed in JP-A 151943/1988, the developer is injected at a flow rate of at least 10 m/min. for agitation of the developer in the developing tank as disclosed in JP-A 151944/1988, the developer is more intensely agitated during development than in the standby state as disclosed in JP-A 264758/1988. For rapid processing, the fixing tank should preferably have a roller arrangement consisting of pairs of opposed rollers to provide an increased fixing rate. The opposed roller arrangement requires a reduced number of rollers, resulting in a compact tank. As a whole, the processor can be made more compact.

The processing apparatus and method of the present invention is applicable to any photosensitive materials, typically general black-and-white photosensitive materials. Examples of such material include laser printing photographic material and printing photosensitive material for medical imaging, medical direct radiographic photosensitive material, medical photofluoroscopic photosensitive material, and CRT image recording photosensitive material.

The photosensitive material generally includes a photographic emulsion on a substrate. The silver halide grains in the photographic emulsion may be grains having a regular crystal form such as cube, octahedron, and tetradecahedron, grains having an irregular crystal form such as sphere, grains having defects like a twin face, or a composite form of these crystal forms, or a mixture of different crystal form grains. Plate grains may also be used which have an aspect ratio of diameter to thickness of from 4 to less than 20, preferably from 5 to 10, provided that the diameter of a grain is the diameter of a circle having an area equal to the projected area of the grain and the thickness is the distance between two approximately parallel major surfaces. The grains preferably have a thickness of up to 0.3 μm, more preferably up to 0.2 μm. One preferred emulsion contains at least 80% by weight, more preferably at least 90% by weight of plate grains based on the total grain weight.

The silver halide emulsion may be either a monodispersed emulsion having a narrow grain size distribution or a multidispersed emulsion having a wide grain size distribution.

The photographic silver halide emulsions used in the practice of the present invention may be prepared by the well-known methods, for example, as described in Research Disclosure, No. 17643 (December 1978), pages 22–23, "I. Emulsion preparation and types," and No. 18716 (November 1979), page 648. General information is described in P. Grafkides, "Chimie et Physique Photographique", Paul Montel (1967), G. F. Duffin, "Photographic Emulsion Chemistry", Focal Press (1966), and V. L, Zelikman et al., "Making and Coating Photographic Emulsion", Focal Press (1964).

A silver halide solvent is used to control the growth of silver halide grains. Examples of the silver halide solvent include ammonia, potassium thiocyanate, ammonium thiocyanate, and thioether compounds as disclosed in U.S. Pat. Nos. 3,271,157, 3,574,628, 3,704,130, 4,297,439, and 4,276,374, thione compounds as disclosed in JP-A 144319/1978, 82408/1978 and 77737/1980, and amine compounds as disclosed in JP-A 100717/1979. Water soluble rhodium and iridium salts may also be used.

The method for reacting a soluble silver salt with a soluble halide salt may be a single jet method, a double jet method, or a combination thereof.

Also employable is a method of forming silver halide grains in the presence of excess silver ions, which is known as a reverse mixing method. One special type of simultaneous mixing method is by maintaining constant the pAg of a liquid phase in which a silver halide is formed, which is known as a controlled double jet method. This method leads to a silver halide emulsion having a regular crystalline shape and a nearly uniform particle size.

Generally, the silver halide emulsion is chemically sensitized. For chemical sensitization purpose, there may be employed sulfur sensitization using a sulfur sensitizing compound (such as allyl thiocarbamide, thiourea, thiosulfate, thioether, and cystine), noble metal sensitization using a noble metal compound (such as potassium chloroaurate, aurous thiosulfate, and potassium chloropalladate), reducing sensitization using a reducing agent (such as stannous chloride, phenylhydrazine, and reductone), and combinations thereof.

The silver halide emulsions used in the practice of the present invention may be spectrally sensitized with spectral sensitizing dyes if desired. The spectral sensitizing dyes used herein are described in F. M. Hamer, "Heterocyclic Compounds—The Cyanine Dyes and Related Compounds," John Wiley & Sons (1964) and D. M. Sturmer, "Heterocyclic Compounds—Special Topics in Heterocyclic Chemistry," John Wiley & Sons (1977). Useful examples include cyanine dyes, merocyanine dyes, rhodacyanine dyes, styryl dyes, hemicyanine dyes, oxonol dyes, benzylidene dyes, and holopolar dyes, with the cyanine and merocyanine dyes being preferred.

The preferred sensitizing dyes are cyanine and merocyanine dyes of the general formulae described in JP-A 133442/1985, 75339/1986, 6251/1987, 212827/1984, 122928/1975, and 1801553/1984. More particularly, sensitizing dyes capable of spectrally sensitizing silver halide in a blue, green, red or infrared spectral region are described in JP-A 133442/1985, pages 8–11, JP-A 75339/1986, pages 5–7 and 24–25, JP-A 6251/1987, pages 10–15, JP-A 212827/1984, pages 5–7, JP-A 122928/1975, pages 7–9, and JP-A 1801553/1984, pages 7–18.

The sensitizing dyes may be used alone or in combination. Combinations of sensitizing dyes are often used particularly for the purpose of supersensitization.

Along with the sensitizing dyes, the emulsions may contain dyes which themselves have no spectral sensitization effect or substances which do not substantially absorb visible light, but have the nature of supersensitization. Useful are aminostilbene compounds having a nitrogenous heterocyclic substituent as described in U.S. Pat. Nos. 2,933,390 and 3,635,721, aromatic organic acid-formaldehyde condensates as described in U.S. Pat. No. 3,743,510, cadmium salts and azaindenes. U.S. Pat. Nos. 3,615,613, 3,615,641, 3,617,295, and 3,635,721 disclose particularly useful mixtures.

The sensitizing dye is preferably contained in the photographic silver halide emulsion in an amount of $5\times10^{-7}$ to $5\times10^{-2}$ mol, more preferably $1\times10^{-6}$ to $1\times10^{-3}$ mol, most preferably $2\times10^{-6}$ to $5\times10^{-4}$ mol per mol of silver halide.

The sensitizing dye may be directly dispersed in the emulsion layer. Alternatively, the sensitizing dye is first dissolved in a suitable solvent, for example, methyl alcohol, ethyl alcohol, methyl cellosolve, acetone, water, pyridine and a mixture thereof, and then added in solution form to the emulsion. Ultrasonic agitation is useful for dissolving purposes. The sensitizing dye may be added in various ways, for example, by dissolving the dye in a volatile organic solvent, dispersing the solution in a hydrophilic colloid, and adding the dispersion to the emulsion as disclosed in U.S. Pat. No. 3,469,987 by dispersing the water-insoluble dye in a water-soluble solvent and adding the dispersion to the emulsion as disclosed in JP-B 24185/1971 by mechanically milling the water-insoluble dye in an aqueous medium for dispersion and adding the dispersion to the emulsion as disclosed in JP-B 45217/1986 by dissolving the dye in a surface-active agent and adding the dispersion to the emulsion as disclosed in U.S. Pat. No. 3,822,135 by dissolving the dye with the aid of a red shifting compound and adding the solution to the emulsion as disclosed in JP-A 74624/1976 and by dissolving the dye in a substantially water-free acid and adding the solution to the emulsion as disclosed in JP-A 80826/1975. Other methods of adding the dye to the emulsion are described in U.S. Pat. Nos. 2,912,343, 3,342,605, 2,996,287, and 3,429,835. The sensitizing dye may be homogeneously dispersed in the silver halide emulsion before the emulsion is coated on a support. The dye may be dispersed at any desired stage during the preparation of the silver halide emulsion, for example, during or before chemical sensitization, or during, before or after formation of silver halide grains as disclosed in U.S. Pat. Nos. 4,183,756 and 4,225,666. It is known that the sensitizing dye is strongly adsorbed by the silver halide when the sensitizing dye is added during or before chemical sensitization or during, before or after grain formation. A photosensitive material having a silver halide emulsion prepared by such a method can be processed according to the present invention without a problem of residual color.

The sensitizing dye mentioned above may be used in combination with another sensitizing dye. Such additional sensitizing dyes are disclosed in U.S. Pat. Nos. 2,615,613, 2,688,545, 3,397,060, 3,416,927, 3,615,632, 3,615,635, 3,617,295, 3,628,964, 3,635,721, and 3,703,377, British Patent Nos. 1,242,588 and 1,293,862, and JP-B 4930/1968, 4936/1968, 10773/1968, and 14030/1969.

The hardening agent used in the photosensitive material includes organic compounds, for example, aldehyde compounds, compounds having active halogen as described in U.S. Pat. No. 3,288,775, compounds having a reactive ethylenically unsaturated group as described in U.S. Pat. No. 3,635,718, epoxy compounds as described in U.S. Pat. No. 3,091,537, halogenocarboxyaldehyde compounds such as mucochloric acid. Vinylsulfon type hardening agents are preferred among others. Polymeric hardening agents are also preferred. Examples of the polymeric hardening agent include polymers having an active vinyl group or a precursor group thereof, especially polymers having an active vinyl group or a precursor group thereof attached to the polymer backbone through a long spacer as disclosed in JP-A 142524/1981. The amount of the hardening agent added varies with its type and the type of gelatin.

For rapid processing, an organic substance which will be dissolved away during development is preferably incorporated in the emulsion layer and/or another hydrophilic colloid layer. If gelatin is used as the dissolvable substance, a gelatin species which does not participate in gelatin crosslinking reaction, for example, acetylated gelatin and phthalated gelatin is preferred, with lower molecular weight ones being more preferred. Useful polymers other than gelatin include hydrophilic polymers such as polyacrylamide as disclosed in U.S. Pat. No. 3,271,158, polyvinyl alcohol and polyvinyl pyrrolidone as well as saccharides such as dextran, sucrose, and pluran. Preferred among others are polyacrylamide and dextran, with the polyacrylamide being most preferred. These polymers have an average molecular weight of up to 20,000, preferably up to 10,000. Besides, antifoggants and stabilizing agents as disclosed in Research Disclosure, Vol. 176, No. 17643, page VI, December 1978 may be used.

The development process according to the present invention is applicable to an image forming process for forming an image having ultra-high contrast, high sensitivity photographic properties on a silver halide photosensitive material using hydrazine derivatives as disclosed in U.S. Pat. Nos. 4,224,401, 4,168,977, 4,166,742, 4,311,781, 4,272,606, 4,221,857, and 4,243,739. The hydrazine derivatives used herein are described in Research Disclosure, No. 23516, November 1983, page 346 and the references cited therein, and U.S. Pat. Nos. 4,080,207, 4,269,929, 4,276,364, 4,278,748, 4,385,108, 4,459,347, 4,478,928, and 4,560,638, British Patent No. 2,011,391B, and JP-A 179734/1985. The hydrazine derivative is preferably added in an amount of $1\times10^{-6}$ to $5\times10^{-2}$ mol, more preferably $1\times10^{-5}$ to $2\times10^{-2}$ mol per mol of silver halide.

The developer used in this type of processing may contain a high contrast promoter, for example, amino compounds as disclosed in U.S. Pat. No. 4,269,929.

EXAMPLE

Examples of the invention are given below by way of illustration and not by way of limitation.

Example 1

Radiographic photosensitive material RX (manufactured by Fuji Photo-Film Co., Ltd.) was imagewise exposed and then processed through a roller transport type automatic processor as shown in FIG. 1. The process was a running operation with continuous replenishment.

| Steps | Temperature | Time |
|---|---|---|
| 1. Development | 35° C. | 25" |
| 2. Fixation | 33° C. | 20" |
| 3. Wash | 20–25° C. | 11" |
| 4. Squeeze | | 9" |
| 5. Drying | 50–55° C. | 18" |

The processing solutions used had the following formulations. Disodium ethylenediaminetetraacetate dihydrate is abbreviated as 2Na-EDTA, hereinafter.

| Developer replenisher | | |
|---|---|---|
| 2 Na-EDTA | | 1.5 g |
| Potassium hydroxide | | 29.0 g |
| Potassium sulfite | | 44.2 g |
| Potassium metabisulfite | | 12.6 g |
| Sodium bicarbonate | | 7.5 g |
| Boric acid | | 1 g |
| Diethylene glycol | | 20 ml |
| 5-methylbenzotriazole | | 0.06 g |
| 5-nitroindazole | | 0.2 g |
| Hydroquinone | | 30 g |
| 1-phenyl-3-pyrazolidone | | 1.5 g |
| Glutaraldehyde | | 5 g |
| Acetic acid | an amount to adjust to pH | 10.35 |
| Water | totaling to | 1 liter |

The developing tank at the start of running operation was filled with a solution which was prepared by adding 4 grams of potassium bromide to 1 liter of the developer replenisher and adjusting it to pH 10.20 with acetic acid.

| Fixer | | |
|---|---|---|
| Ammonium thiosulfate (70 w/v %) | | 200 ml |
| Sodium thiosulfate (anhydrous) | | 30 g |
| Sodium sulfite (anhydrous) | | 20 g |
| Boric acid | | 8 g |
| 2 Na-EDTA | | 0.05 g |
| Aluminum sulfate | | 15 g |
| Sulfuric acid | | 2 g |
| Glacial acetic acid | | 22 g |
| Water | totaling to | 1 liter |

The automatic processor was charged with the above processing solutions and subjected to a running test of processing the radiographic photosensitive material with continuous replenishment.

As described above, the dry-to-dry processing time was 83 seconds, the developing time was 25 seconds, the fixing time was 20 seconds, and the washing time was 11 seconds. The crossover rollers 61, 62 and 64 were removed and washed with water everyday.

The replenishing amount per quarter-size (10×12 inches) sheet of film was 45 ml (585 ml/m$^2$) for the developer and 60 ml (780 ml/m$^2$) for the fixer. The amount of wash water replenished was varied in the range of from 0.1 to 6 liter/m$^2$ as reported in Table 1.

The running test was carried out while controlling the amount of wash water replenished as reported in Table 1. The wash water was kept in the tank in the nighttime and on a holiday without drainage. The daily developing quantity was 100 quarter-size (10×12 inches) sheets of film which corresponded to about 15.4 square meter. Wash water was replenished from a city water supply. The drag-out of the fixer was 26 ml/m$^2$.

An amorphous soluble glass, Biosure SG (Kinki Pipe Giken K.K.) was used as the silver cation sustained release source according to the present invention. It was contained in a bag of water-permeable non-woven fabric and placed near the water inlet port in the wash tank 4. The amount of amorphous soluble glass was 15 grams per liter of the wash tank's wash water volume.

In another running test, the wash water was drained from the tank in the nighttime and on a holiday by opening the electromagnetic valve (43) of the drain system.

For comparison purposes, similar running tests were carried out by adding 0.5 gram/liter of prior art antifungal agents as reported in Table 1. The antifungal agents used were disodium ethylenediaminetetraacetate dihydrate (2Na-EDTA), sodium chloroisocyanurate (SCIC), 2-methyl-5-chloro-4-isothiazolin-3-one (MCITZ), and mixtures thereof.

Bio-slime generation and image stability were examined and reported in Table 1.

As the measure for evaluating the degree of water washing of photosensitive material, a yellowing factor was measured by determining the residual thiosulfate in the film according to the silver nitrate method of ISO 417-1977. In this example, the photosensitive film was processed at a rate of 100 sheets per day and the yellowing factor was measured on the 500th sheet. A density of up to 0.07 is a substantially acceptable yellowing factor for long-term storage under normal conditions.

TABLE 1

| Run No. | Antifungal means | Water replenish (l/m$^2$) | Drainage in quiescent period | Wash-ability | Bio-slime generation | Remarks |
|---|---|---|---|---|---|---|
| 1* | — | 0.1 | NO | 0.230 | foul in 1 week, no use as wash water | spot stains on finished film |
| 2* | $Ag^+$ ion release | 0.1 | NO | 0.218 | | |
| 3* | — | 0.65 | NO | 0.055 | slime in 1 week | white deposits in wash tank |
| 4 | $Ag^+$ ion release | 0.65 | NO | 0.060 | slime in 3 weeks | |
| 5* | — | 2 | NO | 0.033 | slime in 2 weeks | |
| 6 | $Ag^+$ ion release | 2 | NO | 0.037 | slime in 4 weeks | |
| 7* | — | 3.5 | NO | 0.012 | slime in 2 weeks | |
| 8 | $Ag^+$ ion release | 3.5 | NO | 0.014 | slime in 5 weeks | |
| 9* | — | 6 | NO | 0.009 | slime in 2 weeks | |
| 10 | $Ag^+$ ion release | 6 | NO | 0.010 | slime in 5 weeks | |
| 11 | $Ag^+$ ion release | 3.5 | YES | 0.013 | slime in 6 weeks | |
| 12 | $Ag^+$ ion release | 6 | YES | 0.010 | slime in 6 weeks | |
| 13* | 2 Na-EDTA 0.5 g/l | 6 | NO | 0.011 | slime in 3 weeks | |
| 14* | SCIC 0.5 g/l | 6 | NO | 0.010 | slime in 2 weeks | foul odor, tank corroded |
| 15* | SCIC + 2 Na-EDTA 0.5 g/l | 6 | NO | 0.011 | slime in 3 weeks | |
| 16* | MCITZ 0.5 g/l | 6 | NO | 0.009 | slime in 3 weeks | stimulative, toxic |
| 17* | MCITZ + 2 Na-EDTA 0.5 g/l | 6 | NO | 0.010 | slime in 4 weeks | |

*out of the scope of the invention

Example 2

To an emulsion of cubic silver iodobromide grains having a size of 0.3 μm and containing 2.5 mol % of iodide were added 230 mg/mol of silver of anhydrous 5,5-dichloro-9-ethyl-3,3'-bis(3-sulfopropyl)oxacarbocyanine hydroxide sodium salt (sensitizing dye), 1.3 g/mol of silver of a hydrazine derivative of the formula:

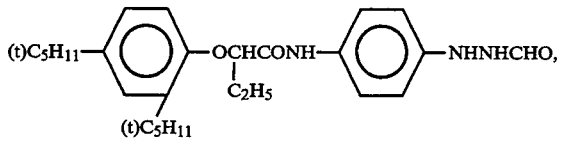

and 300 mg/mol of silver of a polyethylene glycol having a molecular weight of about 1,000. Then, 5-methylbenztriazole, 4-hydroxy-6-methyl-1,3,3a,7-tetraazaindene, polyethylene acrylate dispersion, and 2-hydroxy-1,3,5-triazine sodium salt were added. Further, 1,3-divinyl-sulfonyl-2-propanol hardening agent was added in such an amount as to give a swelling factor of 120%.

The thus obtained coating composition was applied to a polyethylene terephthalate film support, followed by coating of a protective layer. The amount of silver coated was 3.5 g/m$^2$ and the amount of gelatin coated (in both the emulsion and protective layers) was 3.0 g/m$^2$.

The film was exposed to light through a sensitometric exposure wedge using a 150 line magenta contact screen, then developed for 15 seconds with a developer of the following formulation at 40° C., fixed with a fixer GR-F1 manufactured by Fuji Photo-Film Co., Ltd., washed with water, and finally dried.

The automatic processor used was a commercially available processor FG 660F manufactured by Fuji Photo-Film Co., Ltd. which was adjusted to a dry-to-dry processing time of 65 seconds.

| Developer | | |
|---|---|---|
| Hydroquinone | | 50.0 g |
| N-methyl-p-aminophenol | | 0.3 g |
| Sodium hydroxide | | 18.0 g |
| 5-sulfosalicylic acid | | 55.0 g |
| Potassium sulfite | | 110.0 g |
| Disodium ethylenediaminetetraacetate | | 1.0 g |
| Potassium bromide | | 10.0 g |
| 5-methylbenzotriazole | | 0.4 g |
| 2-mercaptobenzimidazole-5-sulfonic acid | | 0.3 g |
| Sodium 3-(5-mercaptotetrazole) benzenesulfonate | | 0.2 g |
| N-n-butyldiethanolamine | | 15.0 g |
| Sodium toluenesulfonate | | 8.0 g |
| Potassium hydroxide | an amount to adjust to pH | 11.6 |
| Water | totaling to | 1 liter |

Wash water was replenished in an amount of 2 liter per full-size (20×24 inches) film sheet, that is, 6.5 l/m$^2$ from a city water supply.

A running test was carried out. The running test schedule included daily development of 30 full-size (20×24 inches) sheets of film and drainage of the wash tank in the nighttime and on a holiday.

A silver cation sustained release agent was placed in the wash tank under the same conditions as in Example 1. Little bio-slime was found over 6 weeks. Image retaining ability was excellent.

For comparison purposes, another running test was carried out without using a silver cation sustained release agent. Bio-slime accumulated in two weeks.

For comparison purposes, a further running test was carried out by replenishing water in an amount of 0.4 l/m$^2$. Although a silver cation sustained release agent was placed in the wash tank, bio-slime accumulated in one week.

Example 3

Preparation of Emulsion

A container was charged with 1 liter of water at 60° C., to which 30 grams of gelatin and 6 grams of potassium bromide were added. With stirring, an aqueous silver nitrate solution (5 grams of silver nitrate) and an aqueous potassium bromide solution containing 0.15 grams of potassium iodide were added to the container over 1 minute by the double jet technique. Further, an aqueous silver nitrate solution (145 grams of silver nitrate) and an aqueous potassium bromide solution containing 4.2 grams of potassium iodide were added to the container by the double jet technique. The flow rate was increased during addition such that the final flow rate was 5 times the initial flow rate. At the end of addition, the soluble salts were removed at 35° C. by the sedimentation technique. Then the temperature was raised to 40° C., 75 grams of gelatin was added to the emulsion, which was adjusted to pH 6.7. The resulting emulsion contained tabular grains having a projected area equivalent diameter of 0.98 μm and a mean thickness of 0.138 μm and had a silver iodide content of 3 mol %. The emulsion was chemically sensitized by gold sensitization combined with sulfur sensitization.

Preparation of Photographic Material

A surface protective layer was prepared from an aqueous gelatin solution containing gelatin, a polyacrylamide having an average molecular weight of 8000, sodium polystyrene sulfonate, polymethyl methacrylate fine particles having an average particle size of 3.0 μm, polyethylene oxide, a hardening agent and other additives.

A coating composition was prepared by adding 500 mg/mol of silver of anhydrous 5,5'-dichloro-9-ethyl-3,3'-di(3-sulfopropyl)oxacarbocyanine hydroxide sodium salt as a sensitizing dye and 200 mg/mol of silver of potassium iodide to the above-prepared emulsion. To the emulsion were further added 4-hydroxy-6-methyl-1,3,3a,7-tetraazaindene and 2,6-bis(hydroxyamino)-4-diethylamino-1,3,5-triazine, and nitron as stabilizing agents, trimethylol propane as a drying antifoggant, a coating aid, and a hardening agent. The coating composition was coated and dried on both the surfaces of a polyethylene terephthalate support at the same time as the surface protective layer, obtaining a photographic material. The amount of silver coated on this photographic material was 2 g/m$^2$ on each surface. The swelling factor as defined in U.S. Pat. No. 4,414,304 was 220%.

The photographic material was exposed to stepwise light using a sensitometer with an optical wedge, then developed, fixed, washed, and finally dried. The formulation of the developer, fixer, and wash water is given below.

| Preparation of developer | | |
|---|---|---|
| Potassium hydroxide | | 17 g |
| Sodium sulfite | | 29 g |
| Potassium sulfite | | 39 g |
| Triethylenetetramine hexaacetate | | 2 g |
| Boric acid | | 3 g |
| Hydroquinone | | 28 g |
| 1-phenyl-3-pyrazolidone | | 1.7 g |
| 5-nitroindazole | | 0.2 g |
| 5-methylbenzotriazole | | 0.02 g |
| Glutaraldehyde | | 5 g |
| Potassium bromide | | 2 g |
| Water | totaling to | 1 liter |
| | pH | 10.25 |

The developing tank of an automatic processor was charged with the developer and replenished as necessary. The replenisher had the same composition as the above-formulated developer except that the potassium bromide was omitted and the solution was at pH 10.50.

| Preparation of fixer | | |
|---|---|---|
| Ammonium thiosulfate (70 w/v %) | | 250 ml |
| Sodium sulfite | | 15 g |
| 2 Na-EDTA | | 0.025 g |
| Sodium hydroxide | | 6 g |
| Acetic acid | an amount to adjust to pH | 4.65 |
| Water | totaling to | 1 liter |

The fixing tank of the automatic processor was charged with the fixer. The replenisher was the same solution.

The automatic processor was adjusted to a dry-to-dry processing time of 50 seconds. It was operated under the following conditions.

| | Volume | Temp. | Time |
|---|---|---|---|
| Developing tank | 11.5 l | 35° C. | 13.6 seconds |
| Fixing tank | 7.5 l | 35° C. | 10.4 seconds |
| Washing tank | 6.0 l | 20° C. | 6.3 seconds |
| Drying | | 50° C. | |

The replenishers were pumped, to the developing and fixing tanks, respectively. The replenishing amounts per quarter-size (10×12 inches) sheet of photosensitive material were:

| | |
|---|---|
| developer replenisher | 30 ml |
| fixer replenisher | 40 ml. |

In the wash tank, a bag of non-woven fabric containing 100 g of Biosure SG was placed and water was supplied during development in an amount of 6.5 $l/m^2$ from a city water supply. The wash tank was emptied of the wash water in the nighttime and on a holiday.

A running test was carried out for 3 months. The running test schedule included daily development of 50 quarter-size (10×12 inches) sheets of film. Substantially no bio-slime accumulated so that the wash tank could be easily cleaned.

Example 4

(1) Preparation of Silver Halide Emulsion

A container was charged with water, gelatin and potassium bromide and heated to 55° C. A suitable amount of ammonia was added to the container. While maintaining the pAg at 7.60 in the container, an aqueous silver nitrate solution and an aqueous potassium bromide solution containing a sufficient amount of hexachloroiridate (III) to provide a molar ratio of iridium to silver of $10^{-7}$ were added to the container by the double jet technique. By changing the amount of ammonia, there were obtained two monodispersed emulsions of silver bromide grains having an average grain size of 0.70 μm and 0.40 μm. In these emulsions, 98% of the grains fell within the range of ±40% of the average grain size. At the later stage of grain formation, $1\times10^{-3}$ mol/mol of silver of potassium iodide was added. After desalting, the emulsions were adjusted to pH 6.2 and pAg 8.6 and then gold/sulfur sensitized with sodium thiosulfate and chloroauric acid to desired photographic properties. These emulsions had a ratio of (100) to (111) face of 93/7 as measured by Kubelka-Munk method.

(2) Preparation of an Emulsion Coating Composition

A 0.5-kg portion of each of the two emulsions was weighed and placed in a container. After the emulsion was melted by heating to 40° C., there were added 30 cc of a methanol solution of $9\times10^{-4}$ mol/l of the infrared sensitizing dye shown below, 130 cc of an aqueous solution of $4.4\times10^{-3}$ mol/l of disodium 4,4'-bis[4,6-di(-naphthyl-2-oxy)pyrimidin-2-ylamino]stilbene -2,2'-disulfonate supersensitizer, 35 cc of a methanol solution of $2.8\times10^{-2}$ mol/l of the photosensitive material stabilizer shown below, an aqueous solution of 4-hydroxy-6-methyl-1,3,3a,7-tetraazaindene, an aqueous solution of dodecylbenzene sulfonate coating aid, and an aqueous solution of poly(potassium p-vinylbenzene sulfonate) thickener.

Infrared sensitizing dye:

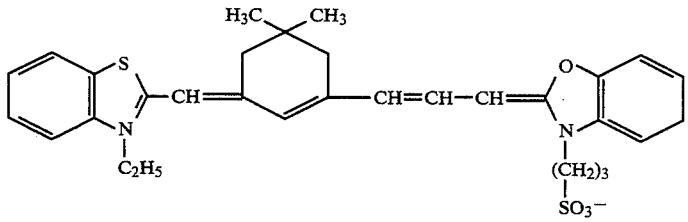

Photosensitive material stabilizer:

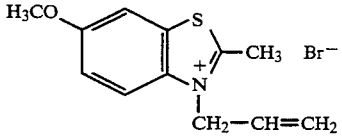

(3) Preparation of a Coating Composition Forming a Surface Protective Layer on the Emulsion Layer A coating composition was prepared by adding to a 10 wt % gelatin aqueous solution at 40° C. an aqueous solution of polystyrene sodium sulfonate thickener, fine particulate polymethyl methacrylate matte agent (average particle size 3.0 μm), N,N'-ethylene-bis(vinylsulfonylacetamide) hardener, an aqueous solution of sodium t-octylphenoxyethoxyethane sulfonate coating aid, an aqueous solution of a polyethylene surface-active agent as an antistatic agent, and an aqueous solution of fluorine-containing compounds of the following formulae:

$C_8F_{17}SO_2N(C_3H_7)CH_2COOK$ and $C_8F_{17}SO_2N(C_3H_7)(CH_2CH_2—O)_{15}—H$.

(4) Preparation of a Back Layer Coating Composition

A coating composition was prepared by adding to 1 kg of a 10 wt % gelatin aqueous solution at 40° C. an aqueous solution of polystyrene sodium sulfonate thickener, 50 cc of an aqueous solution of $5\times10^{-2}$ mol/l of the back dye shown below, an aqueous solution of N,N'-ethylene-bis(vinylsulfonylacetamide) hardener, and an aqueous solution of sodium t-octylphenoxyethoxyethane sulfonate coating aid.

Back dye:

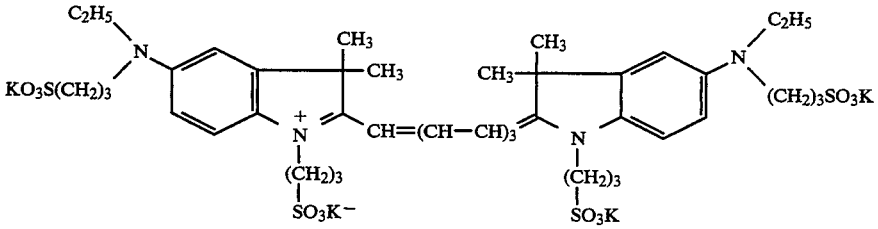

(5) Preparation of a Coating Composition Forming a Surface Protective Layer on the Back Layer A coating composition was prepared by adding to a 10 wt % gelatin aqueous solution at 40° C. an aqueous solution of polystyrene sodium sulfonate thickener, fine particulate polymethyl methacrylate matte agent (average particle size 3.0 μm), an aqueous solution of sodium t-octylphenoxyethoxyethane sulfonate coating aid, an aqueous solution of a polyethylene surface-active agent as an antistatic agent, and an aqueous solution of fluorine-containing compounds of the following formulae:

$C_8F_{17}SO_2N(C_3H_7)CH_2COOK$ and $C_8F_{17}SO_2N(C_3H_7)(CH_2CH_2—O)_{15}—H$.

(6) Preparation of Coated Samples

The back layer coating composition (4) was coated on one surface of a polyethylene terephthalate support along with the surface protective layer coating composition (5) for the back layer so as to give a gelatin coating weight of 4 g/m². Thereafter, the emulsion coating composition (2) containing the near infrared sensitizing dye was coated on the other surface of the support along with the surface protective layer coating composition (3) for the emulsion layer so as to give a silver coating weight of 3.5 g/m². The amount of the hardener in the surface protective layer coating composition was adjusted such that the coating had a swelling factor of 100%.

(7) Measurement of Swelling Factor

The swelling factor was determined by incubating a coated sample at 38° C. and RH 50%, measuring the thickness of the coating, immersing in distilled water at 21° C. for 3 minutes, measuring the thickness of the swollen coating, and dividing the final thickness by the initial thickness to calculate a percent variation of coating thickness.

Processing

The photosensitive material was processed through an automatic processor of the structure shown in FIG. 2. The developer and fixer concentrates used herein had the following compositions.

| Developer concentrate | | |
|---|---|---|
| Potassium hydroxide | | 56.6 g |
| Sodium sulfite | | 200 g |
| Diethylenetriamine pentaacetic acid | | 6.7 g |
| Potassium carbonate | | 16.7 g |
| Boric acid | | 10 g |
| Hydroquinone | | 83.3 g |
| Diethylene glycol | | 40 g |
| 4-hydroxymethyl-4-methyl-1-phenyl-3-pyrazolidone | | 5.5 g |
| 5-methylbenzotriazole | | 2 g |
| Water | totaling to | 1 liter |
| | pH | 11.00 |
| Replenisher kit size | | 5 liters |
| Fixer concentrate | | |
| Ammonium thiosulfate | | 560 g |
| Sodium sulfite | | 60 g |
| 2 Na-EDTA | | 0.10 g |
| Sodium hydroxide | | 24 g |
| Acetic acid | an amount to adjust to pH | 5.10 |
| Water | totaling to | 1 liter |
| Replenisher kit size | | 5 liters |

Wash Water

The water stock tank was filled with city water and 50 grams of Biosure SG was placed in the tank.

The automatic processor was adjusted to a dry-to-dry processing time of 60 seconds. It was operated under the following conditions.

| | Volume | Temp. | Time |
|---|---|---|---|
| Developing tank (2) | 7.5 l | 35° C. | 11.5 seconds |
| Fixing tank (3) | 7.5 l | 35° C. | 12.5 seconds |
| Washing tank (4) | 6.0 l | 20° C. | 7.5 seconds |
| Roller clean sump (72) | 200 ml | | |
| Water stock tank (17) | 25 l | | |
| Drying section (9) | | 50° C. | |

The developing and fixing tanks were maintained at the indicated temperature by means of heaters, but without cooling water.

At the start of development process, the respective tanks were filled with the following solutions.

Developing Tank

A developer was prepared by adding 667 ml of water and 10 ml of an aqueous solution containing 2 grams of potassium bromide and 1.8 grams of acetic acid to 333 ml of the developer concentrate. The developer was at pH 10.50.

Fixing Tank

A fixer was prepared by adding 750 ml of water to 250 ml of the fixer concentrate.

Wash Tank, Water Stock Tank, Roller Clean Sump

City water was used. Bags each containing 50 grams of Biosure SG were placed on the bottom of the wash tank and the water stock tank.

The running process was continued for 3 months. The replenishers were pumped to the developing, fixing, and washing tanks, respectively, during the process. That is, 40 ml of a developer replenisher consisting of 20 ml of the developer concentrate plus stock water was delivered to the developing tank (2), 30 ml of a fixer replenisher consisting of 10 ml of the fixer concentrate plus overflow water from the wash tank (4) was delivered to the fixing tank (3), and 60 ml of wash water was replenished from the water stock tank (17) to the wash tank (4) through the squeeze roller cleaning sump (72), all the replenishing amounts being per B4-size (25.7×36.4 cm) sheet of photosensitive material.

At the end of daily development operation, 80 ml of wash water was pumped from the water stock tank (17) to each of roller cleaning spargers (73, 74) to spray water to the crossover rollers (62, 63, 61) thereby cleaning the crossover roller racks. If the developer, fixer and water became short, their replenishers were additionally used from the stock. Throughout the process, the operation was very easy without a special maintenance except that the stock replenishers and water were furnished as needed. Photographic properties were excellent.

Example 5

Using an automatic processor FPM-9000 manufactured by Fuji Photo-Film Co., Ltd., medical radiographic photosensitive films, Super HR-S, Super HR-A, Super HR-L and Super HR-C manufactured by Fuji Photo-Film Co., Ltd. were processed in an area ratio of about 8:1:1:1 on a quarter-size basis in a total quantity of 150 quarter-size (10×12 inches) sheets per day.

SP processing was carried out at a temperature of 35° C. for a dry-to-dry processing time of 45 seconds. The developer used was RD-7 which was replenished in an amount of 45 ml per quarter-size (10×12 inches) sheet, and the fixer was Fuji F which was replenished in an amount of 45 ml per quarter-size (10×12 inches) sheet. Wash water was supplied at a flow rate of 5 l/min. during processing.

At the end of daily operation, the wash tank was automatically emptied of water by opening the electromagnetic valve in the drain pipe.

Bio-slime accumulated in two weeks in the wash tank when no anti-slime means was applied.

In the practice of the invention, anti-slime means was applied.

In a first run, two non-woven fabric bags each containing 200 grams of a silver cation-releasing amorphous soluble glass were placed on the bottom of the wash tank. The glass had the composition $Na_2O/B_2O_3/SiO_2=10/65/25$ in % by weight containing 1.7% by weight of Ag. Little bio-slime accumulated for 3 months and no special cleaning was necessary with satisfactory operation.

In a second run, Caribbean Clear Swimming Pool Purifier model 25R marketed from Caribbean Clear International was set in the wash tank. DC current of 20 mA and 0.3 V was conducted across a pair of electrodes of silver/copper (13/87 wt %) alloy to electrolytically release silver cations when the wash tank was full of water. Little bio-slime accumulated for 3 months and no special cleaning was necessary with satisfactory operation.

Example 6

The processor, material, and procedure used are substantially the same as in Example 4.

In this example, ozone generating means of the configuration shown in FIG. 3 was set in the wash tank (4). The filter (25) was an active carbon filter, Secard MR-4 by Shinagawa Shirorenga K.K. (100 grams). The ozone generator (24) was Pasteur Ozonizer LB-30 by Ozone K.K.

A running test was carried out by supplying ozone for 5 minutes at intervals of 1 hour during the operation of the processor (including standby states). The amount of air blown was 3 liter/min. and the amount of ozone generated was 50 mg/hour.

Silver cation sustained release combined with ozone supply was effective in controlling bio-slime because the time until bio-slime generation was further extended by the additional ozone supply.

Example 7

The processor, material, and procedure used are approximately the same as in Example 3.

In this example, the wash tank had the bottom configuration shown in FIG. 8 where the inclination angle $\alpha$ was 5° and the height h was 25 mm.

A running test was carried out for 3 months. The running test schedule included daily development of (average) 150 quarter-size (10×12 inches) sheets of film. At the end of daily operation, the wash tank was automatically emptied of water by opening the electromagnetic valve in the drain pipe. Substantially no bio-slime accumulated and the transport roller mount rack in the wash tank need not be cleaned.

In another run, the drainage sequence of the control system was changed. This sequence included the steps of automatically opening the electromagnetic valve in the drain pipe to empty the wash tank of water at the end of daily operation, filling the tank with fresh water, emptying the tank of the water again, and causing the transport rollers in the tank to idle to splash off remaining water droplets. No bio-slime accumulated in the wash tank.

In a further run, an additional sequence of automatically draining wash water when the standby state continued over one hour was programmed in the control system. Better results were obtained.

Example 8

The processor, material, and procedure used are approximately the same as in Example 7.

In this example, a wash tank drying system of the configuration shown in FIGS. 5 and 6 was added to the processor. At the end of daily operation, the wash water was drained, and then the baffle (31) was turned to close the duct (97) path and open the port to the conduit (30). Warm air at 50°–58° C., which was normally used for drying the photosensitive film, was introduced into the wash tank (4) through the conduit (30) at a flow rate of 2,000 liter/min., thereby drying the interior of the wash tank (4).

The time until bio-slime generation was extended about 50% as compared with Example 7.

In another run, the drainage sequence of the control system was changed. This sequence included the steps of automatically draining the wash water at the end of daily operation, filling the tank with fresh water, emptying the tank of the water again, causing the transport rollers in the tank to idle to splash off remaining water droplets, and drying the wash tank with blowing warm air. No bio-slime accumulated in the wash tank. The time until bio-slime generation was further extended.

According to the present invention, significant biocidal and fungicidal effects are achieved by dissolving silver cations in wash water in the wash tank of a processor. Bio-slime resulting from microbial accumulation is thus minimized. Since the invention is applicable to the large volume water washing mode, a roller transport system of complicated structure generally used in such a mode becomes substantially slime-free so that its maintenance is very easy. Biocidal and fungicidal effects are enhanced by supplying ozone into wash water. Slime formation is minimized by draining water from the wash tank during a quiescent period.

Obviously many variations and modifications of the present invention are possible in the light of the above teachings. It is therefore to be understood that within the scope of the appended claims, the invention may be practiced otherwise than as specifically described.

We claim:

1. A method for controlling bio-slime formation in a washing tank of an automatic processor, said washing tank having a discharge port at a bottom thereof and containing water during an operating period of said processor, said method comprising the steps of:

emptying said washing tank during a quiescent period of said processor;

filling said washing tank with fresh water; and emptying said washing tank again so as to prevent bio-slime formation during the quiescent period.

2. A method for controlling bio-slime formation in a water washing tank of an automatic processor, said washing tank having a discharge port at a bottom thereof and at least one transporting roller for passage of photosensitive material through the tank, said washing tank being full of water during an operating period of said processor, said method comprising the steps of:

discharging the water from said washing tank through said discharge port during a quiescent period of the processor;

causing said transporting roller to rotate during said quiescent period so as to remove water droplets thereon thereby preventing bio-slime formation during the quiescent period.

3. A photosensitive material processing apparatus comprising:

a processing section including at least a developing tank, a tank for a fixing function, and a water washing tank in juxtaposition for processing photosensitive material, said washing tank having means for discharging water therefrom; and a drying section having means for supplying a drying gas to the processed photosensitive material for drying;

means for channeling said drying gas to said washing tank when said washing tank has been emptied of water.

4. A method for controlling bio-slime formation in the washing tank of a photosensitive material processing apparatus comprising the steps of:

discharging water from said washing tank; and thereafter forcedly drying the interior of said washing tank.

5. A method for controlling bio-slime as claimed in claim 1 wherein said washing tank has a slanted bottom and a discharge port formed in said slanted bottom, said water being emptied through said discharge port during said emptying steps.

* * * * *